US006629015B2

(12) United States Patent
Yamada

(10) Patent No.: US 6,629,015 B2
(45) Date of Patent: Sep. 30, 2003

(54) EMBROIDERY DATA GENERATING APPARATUS

(75) Inventor: Kenji Yamada, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 271 days.

(21) Appl. No.: 09/757,469

(22) Filed: Jan. 11, 2001

(65) Prior Publication Data

US 2002/0038162 A1 Mar. 28, 2002

(30) Foreign Application Priority Data

Jan. 14, 2000 (JP) ..... 2000-010139

(51) Int. Cl.[7] ..... D05C 5/02; G06F 7/66
(52) U.S. Cl. ..... 700/138; 700/136; 112/102.5
(58) Field of Search ..... 700/138, 90–144; 112/78–103

(56) References Cited

U.S. PATENT DOCUMENTS 5,343,401 A * 8/1994 Goldberg et al. ..... 700/138
5,751,583 A * 5/1998 Kyuno et al. ..... 700/138
5,794,553 A * 8/1998 Futamura ..... 700/138
5,839,380 A * 11/1998 Muto ..... 700/138

FOREIGN PATENT DOCUMENTS

| | | |
|---|---|---|
| JP | 2-221453 | 9/1990 |
| JP | 11-114260 | 4/1999 |
| JP | 11-131827 | 5/1999 |
| JP | 11-169568 | 6/1999 |

OTHER PUBLICATIONS

U.S. patent application Ser. No. 09/538,296, Kenji Yamada, filed Mar. 30, 2000.

* cited by examiner

*Primary Examiner*—Albert W. Paladini
*Assistant Examiner*—Walter R. Swindell
(74) *Attorney, Agent, or Firm*—Oliff & Berridge, PLC

(57) ABSTRACT

A method for generating embroidery data based on an image including a plurality of pixels. A plurality of line segment data is generated for pixel groups, each pixel group including at least one pixel based therein. Each of the line segment data defines a line segment by an angle component in which the line segment extends, a length component indicating a length of the line segment and a color component indicating a color of the line segment. The embroidery data is generated based on the plurality of line segment data, so as to give embroidery stitches along the line segments.

25 Claims, 25 Drawing Sheets

| | | |
|---|---|---|
| 1 | 1 | 1 |
| 1 | −8 | 1 |
| 1 | 1 | 1 |

Fig. 7A

| | | |
|---|---|---|
| 100 | 50 | 50 |
| 200 | 100 | 50 |
| 200 | 200 | 100 |

Fig. 7B

| | | |
|---|---|---|
| 50 | 0 | * |
| 100 | 50 | * |
| 0 | 100 | * |

Fig. 7C

| | | |
|---|---|---|
| 0 | 0 | * |
| 0 | 0 | * |
| * | * | * |

Fig. 7D

| | | |
|---|---|---|
| 100 | 50 | 0 |
| 0 | 100 | 50 |
| * | * | * |

Fig. 7E

| | | |
|---|---|---|
| * | 150 | 50 |
| * | 100 | 150 |
| * | * | * |

Fig. 8A

| | | |
|---|---|---|
| -1 | 0 | 1 |
| -1 | 0 | 1 |
| -1 | 0 | 1 |

PREWITT OPERATOR
(VERTICAL)

Fig. 8B

| | | |
|---|---|---|
| -1 | -1 | -1 |
| 0 | 0 | 0 |
| 1 | 1 | 1 |

PREWITT OPERATOR
(HORIZONTAL)

Fig. 8C

| | | |
|---|---|---|
| -1 | 0 | 1 |
| -2 | 0 | 2 |
| -1 | 0 | 1 |

SOBEL OPERATOR
(VERTICAL)

Fig. 8D

| | | |
|---|---|---|
| -1 | -2 | -1 |
| 0 | 0 | 0 |
| 1 | 2 | 1 |

SOBEL OPERATOR
(HORIZONTAL)

| | | |
|---|---|---|
| 30 | 20 | 40 |
| 30 | 20 | 40 |
| 30 | 20 | 40 |

| | | |
|---|---|---|
| 40 | 8.3 | 45 |
| | 8.3 | 45 |
| 35 | 8.3 | 50 |

EMBROIDERY DATA GENERATING APPARATUS

BACKGROUND OF THE INVENTION

1. Field of Invention

The invention relates to an embroidery data generating apparatus that generates embroidery data, based on an image colored in subtle gradations of various colors, for forming embroidery that resembles the image very closely. The invention also relates to a computer-readable program memory that stores an embroidery data generating program.

2. Description of Related Art

There are provided, in the field of home-use sewing machines, various embroidery data generating apparatuses that generate embroidery data based on images (such as pictures and patterns). The embroidery data generating apparatuses comprise a personal computer (PC) connecting with an image scanner, a hard disk unit, a keyboard and a CRT display.

In the case of generating the embroidery data by using such conventional embroidery data generating apparatuses, the image scanner first captures an original image and then outputs image data to the PC. The PC extracts, based on the image data, outlines and centerlines that define closed areas from the captured image, and generates the embroidery data for fill stitches or satin stitches in the closed areas defined by the outlines, and/or for running stitches or zigzag chain stitches along the outlines and centerlines.

The conventional embroidery generating apparatus uses the image data only for extracting the outlines and centerlines, as described above. Accordingly, the original image is required to have clear outlines, so that the PC can identify and extract the outlines with high reliability. In other words, an original image colored in subtle gradations of various colors is not recommended for generating the embroidery data, because the PC can not identify the outlines exactly.

However, there have been recently proposed embroidery data generating apparatuses that calculate color changes in subtle color gradations of images, and automatically generate embroidery data by reflecting the calculated color change on thread colors to be used in the embroideries.

For example, Japanese Laid-Open Patent Publications No. 2-221453 and No 11-169568 disclose embroidery data generating apparatuses that can reflect color changes of images on thread color exchange. More specifically, the apparatus captures image data by using an image scanner, and divides the captured image data into a plurality of divided image data by rectangular image areas. These image areas are arranged in matrix form. Then, the apparatus converts the image data into mosaic image data, based on the divided image data, in response to the gradations of the image areas. The apparatus generates the embroidery data for forming cross stitches or satin stitches in the respective image areas, the thread colors corresponding to the gradations of the image areas. That is, the thread colors have to be exchanged in the case where the color gradations change between image areas. The apparatus inserts stop cords into the embroidery data for stopping sewing operations at the positions for exchanging the thread colors.

Japanese Laid-Open Patent Publication No. 11-114260 discloses another embroidery data generating apparatus that can automatically generate embroidery data, with appropriate stitch directions and thread densities for forming embroidery, based on color gradations in the image. The apparatus captures image data by using an image scanner, and divides the captured image data into a plurality of divided image data by rectangular image areas in matrix form. After extracting edges from the image data, the apparatus determines a stitch direction for each image area based on the extracted edge in the image area and, at the same time, determines thread density for each image area based on pixel density in the image area. Then, the apparatus develops stitches for respective image areas based on the determined stitch directions and the thread densities, and generates the embroidery data by connecting the developed stitches.

Incidentally, it is necessary to resolve issues of "resolution" and "color" in the case of forming the embroidery based on the image data colored in subtle color gradations.

The embroidery is made up of a plurality of stitches given on a workpiece, and each stitch is given by a needle and a thread. Thus, the stitches can not be formed in pieces smaller than the thickness of needle and the thickness of thread. Especially, the embroidery sewing machine needs to use a needle and thread each having sufficient thickness the needle does not snap and the thread does not break. This poses serious limitations in forming the embroidery at a high resolution. In addition, when the needle drops at the same position many times, the threads can easily get entangled with one another or break, and the needle is apt to snap.

Further, there is a need for a large number of thread colors to reproduce the subtle color gradations in the embroidery. It is not realistic to keep threads of hundreds, or even thousands, of different colors. Even if such a large number of threads are ready, it is also not realistic to exchange such a number of threads. Thus, it is necessary to reproduce the color gradations as close to the real color by using a maximum of twenty different colored threads.

All the above-mentioned embroidery data generating apparatuses divide the captured image into a plurality of rectangular image areas, convert the image data into the mosaic image data in response to the color gradations of the image areas, and generate the embroidery data for providing stitches for respective image areas in thread colors corresponding to the color gradations of the image areas. In other words, the image area has to have a greater width than a minimum stitch length (for example, 2 to 3 mm), and is colored in the thread color determined by compressing the color gradations. Therefore, the conventional embroidery data generating apparatuses do not fully resolve the above-mentioned issues.

SUMMARY OF THE INVENTION

The invention has been developed to resolve the above-mentioned and other problems.

According to one aspect of the invention, there is provided a method for generating embroidery data for forming an embroidery based on an image colored in a subtle gradation of various colors. More specifically, there is provided a method for generating embroidery data based on image data that represents an image including a plurality of pixels, comprising generating, based on the image data, a plurality of line segment data including respective angle components, respective length components and respective color components, each of the plurality of line segment data corresponding to one pixel group that includes at least one pixel therein and defining a line segment, the angular component indicating a direction in which the line segment extends, the length component indicating a length of the line segment, and the color component indicating a color of the line segment; and generating the embroidery data based on the plurality of line segment data, the embroidery data providing embroidery stitches along the line segments defined by the plurality of line segment data.

According to another aspect of the invention, there is provided a computer-readable memory medium that stores an embroidery data generating program for generating embroidery data, for the use with an embroidery sewing machine, the embroidery data generating program comprising a program for generating, based on the image data, a plurality of line segment data including respective angle components, respective length components and respective color components, each of the plurality of line segment data corresponding to one pixel group that includes at least one pixel therein and defining a line segment, the angular component indicating a direction in which the line segment extends, the length component indicating a length of the line segment, and the color component indicating a color of the line segment; and a program for generating the embroidery data based on the plurality of line segment data, the embroidery data giving embroidery stitches along the line segments defined by the plurality of line segment data.

According to still another aspect of the invention, there is provided an embroidery data generating apparatus that generates embroidery data, comprising a line segment data generating unit that generates, based on the image data, a plurality of line segment data including respective angle components, respective length components and respective color components, each of the plurality of line segment data corresponding to one pixel group that includes at least one pixel therein and defining a line segment, the angular component indicating a direction in which the line segment extends, the length component indicating a length of the line segment, and the color component indicating a color of the line segment; and an embroidery data generating unit that generates the embroidery data based on the plurality of line segment data, the embroidery data providing embroidery stitches along the line segments defined by the plurality of line segment data.

As described above, the embroidery data is generated based on the plurality of the line segment data in the invention, so that the embroidery stitches are provided along the line segments defined by the line segment data. The line segment data is generated for each pixel group, based on an image feature, including its angle, length and color components. According to the invention, it is possible to form the embroidery that resembles the image very closely, as stitch directions wield a large influence on embroidery sewing quality. Even if the line segments are equal to the minimum stitch length, it becomes possible to form, based on the embroidery data of the invention, an embroidery that resembles the image more closely than ever.

Preferably, the line segment data is generated for each pixel group, based on the angular characteristic and its intensity. Especially, the line segment data is generated, with high priority, for one pixel having a higher angular characteristic intensity than the threshold value. The line segment data is generated for any pixel having a lower angular characteristic intensity than the threshold value only when the any pixel is not located on the previously generated line segments. This allows generation of embroidery data that reflects the image feature as closely as possible, without loss of embroidery sewing quality by unnecessary embroidery stitches.

BRIEF DESCRIPTION OF THE DRAWINGS

The above-mentioned and other aspects and advantages of the invention will become apparent from the following detailed description of preferred embodiments when taken in conjunction with the accompanying drawings, in which:

FIGS. 7A to 7E schematically show how the angular characteristic and its intensity are calculated for each pixel;

FIGS. 8A and 8B show Prewitt operators in a horizontal direction and a vertical direction, respectively;

FIGS. 8C and 8D show Sobel operators in a horizontal direction and a vertical direction, respectively;

DETAILED DESCRIPTION OF PREFERRED EMBODIMENTS

An explanation will be given of an embroidery data generating apparatus 1 in accordance with the invention based on the following preferred embodiment.

Firstly, the overall structure of the embroidery data generating apparatus 1 will be described while referring to FIGS. 1 and 2. The embroidery data generating apparatus 1 is for generating and editing embroidery data. The generated embroidery data can be stored in a nonvolatile memory, such as a memory card, and provided to an embroidery sewing machine (not shown in the figures).

The embroidery sewing machine holds a workpiece by an embroidery hoop on a machine bed, and forms an embroidery from embroidery stitches on the workpiece by the sewing workings of a machine needle and a rotary hoop while moving the embroidery hoop to a designated position at each stitch. The embroidery sewing machine comprises a control unit, including a microprocessor arranged within the sewing machine, for controlling the sewing workings of the machine needle and the rotary hook as well as the horizontal movements of the embroidery hoop.

The control unit controls the execution of the embroidery sewing workings by being given the movement of the machine needle in the X- and Y-axes directions. The movement of the machine needle is herein referred to as embroidery data that provides the respective stitch points.

The embroidery sewing machine further comprises a memory card device that reads the embroidery data stored in a memory card. Thus, the embroidery data can be generated in an external device and, then, supplied to the embroidery sewing machine. While described as using a memory card, other read/write devices and storage means can be used, such as hard disk, floppy disk, CVD and DVD.

Figure 1:
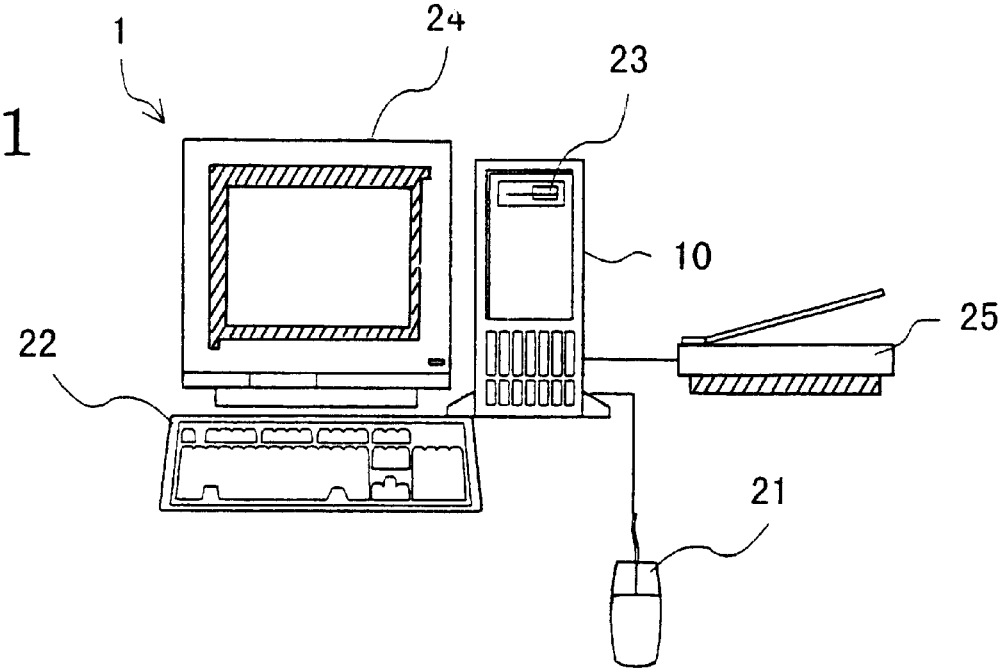
FIG. 1 is a perspective view of an embroidery data generating apparatus according to the invention.

FIG. 1 is a perspective view of the embroidery data generating apparatus 1. The embroidery data generating apparatus 1 comprises a controller 10, a mouse 21, a keyboard 22, a memory card connector 23, a display 24 and an image scanner 25. The controller 10 executes a series of processes for generating the embroidery data. The mouse 21 and the keyboard 22 are for entering any user-selected commands to the controller 10. The memory card connector 23 is for storing the generated embroidery data into the memory card. The image scanner 25 captures an original image and supplies image data to the controller 10. The image data may also be supplied from an external memory device (not shown in figures), such as a magnetic storage medium, CD-ROM, a CD-R, and a DVD.

Figure 2:
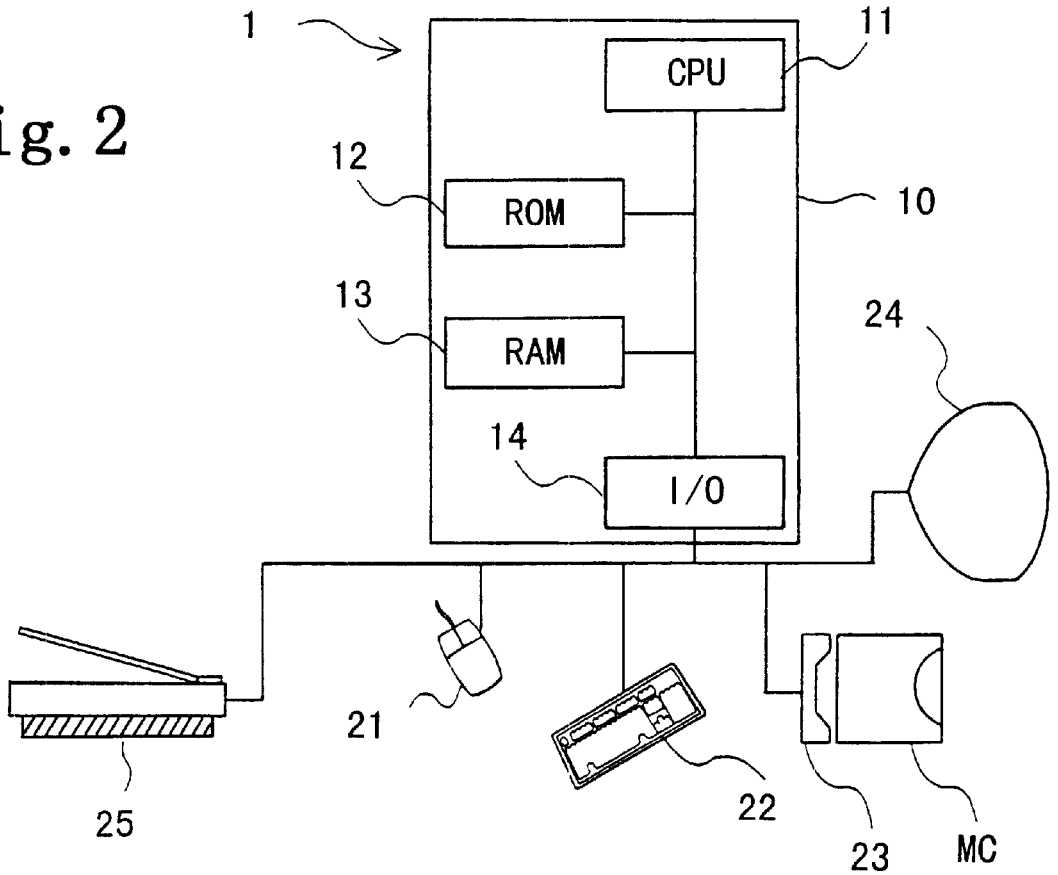
FIG. 2 is a block diagram of a controller of the embroidery data generating apparatus of FIG. 1.

FIG. 2 is a block diagram of the controller 10. The controller 10 comprises a CPU 11, a ROM 12, a RAM 13 and an I/O interface 14. The controller 10 is connected, via the I/O interface 14, with the mouse 21, the keyboard 22, the memory card connector 23, the display 24 and the image scanner 25. The CPU 11 executes various operations, such as extracting outlines of the original image, generating line segment data, generating the embroidery data, and editing the embroidery data according to an embroidery data generating program of the invention. The ROM 12 stores the embroidery data generating program in this embodiment. The RAM 13 optionally stores image data supplied from the image scanner 25 and the external memory device.

The controller 10 may be incorporated in a general-purpose computer, such as a PC, and further comprise a hard disk device (not shown in the figures). In such a case, the embroidery data generating program can be stored in the hard disk device, and loaded into the RAM 13 to be executed.

Figure 3:
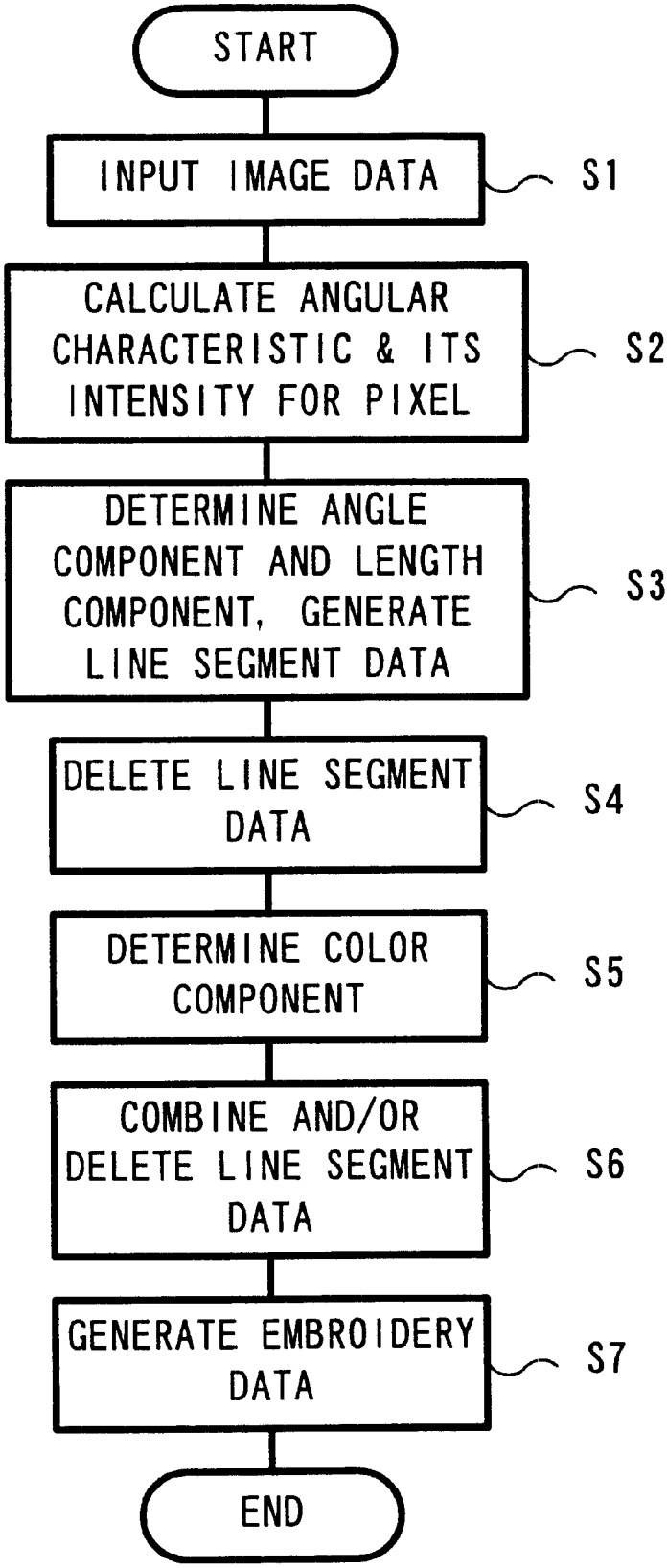
FIG. 3 is a flowchart for generating embroidery data according to the invention.
Figure 4:
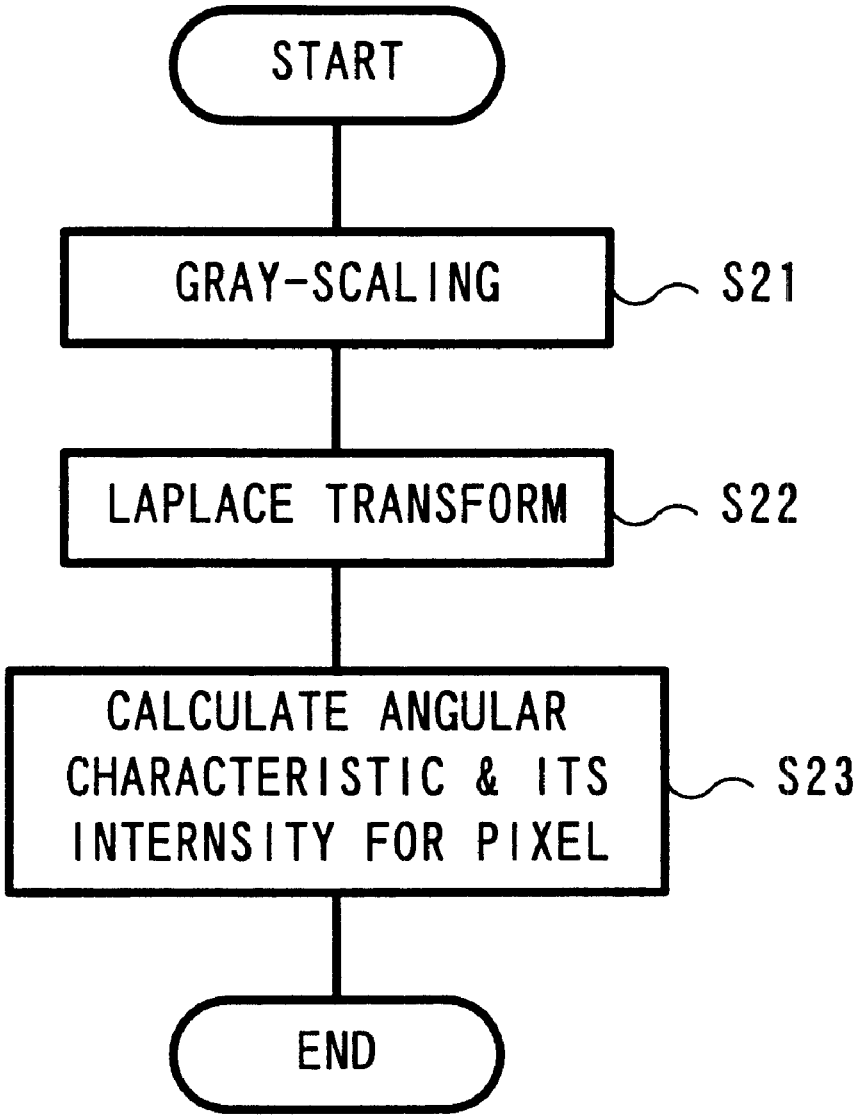
FIG. 4 is a flowchart for calculating an angular characteristic and its intensity for each pixel.
Figure 5:
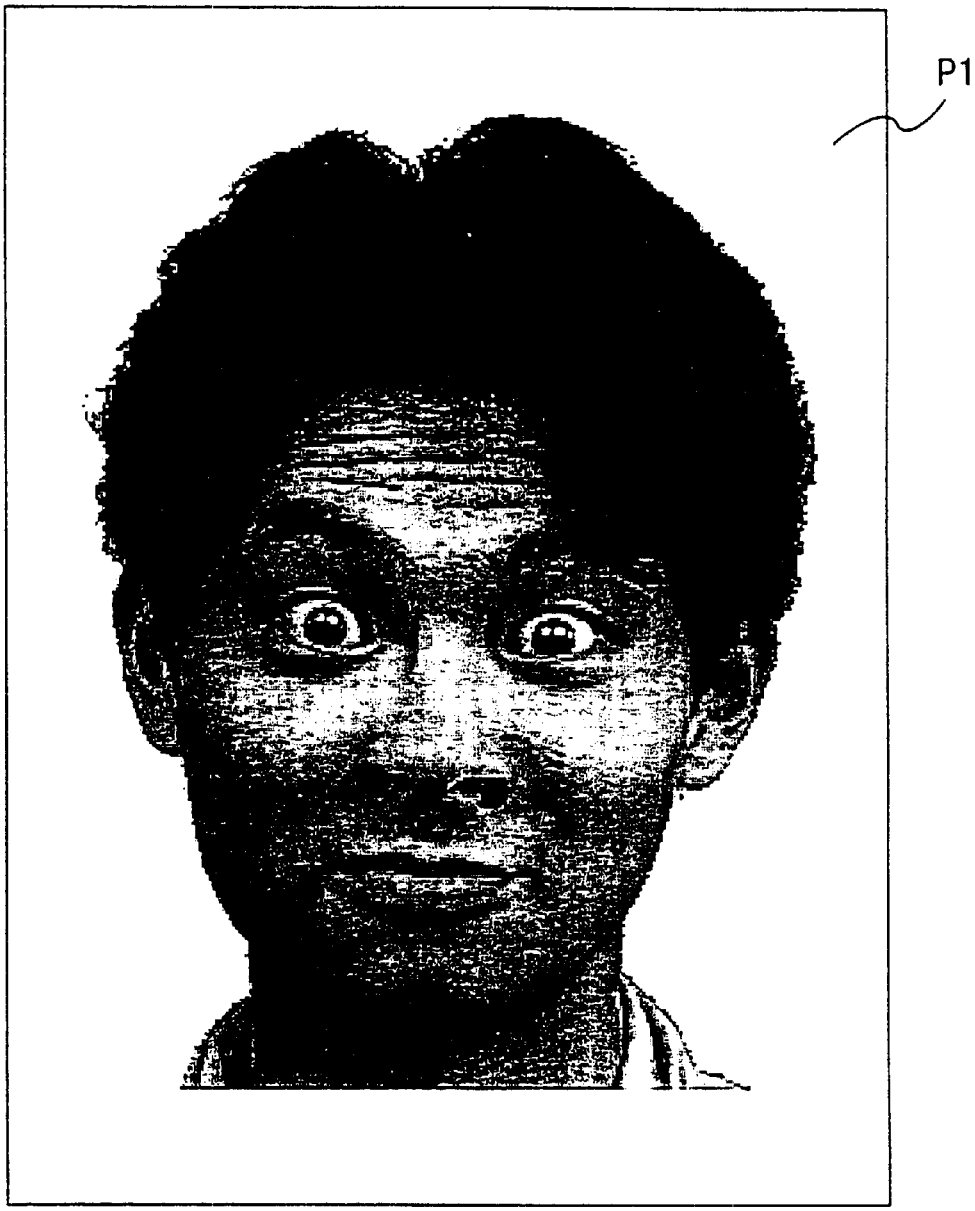
FIG. 5 shows one example of original image.

The procedure of generating the embroidery data according to the invention will be explained with reference to FIGS. 3 to 5. FIG. 3 is a flowchart for generating the embroidery data, FIG. 4 is a flowchart for calculating an angular characteristic and its intensity for each pixel in the captured original image, and FIG. 5 is one example of an original image. The explanation given assumes the embroidery data is generated based on the original image of FIG. 5.

First, the image scanner 25 captures an original image P1 (shown in FIG. 5) and inputs the image data into the controller 10 in step S1. The image data is made up of pixel data for a plurality of pixels. As described above, the image data may be directly input from the external memory device.

In step S2, the angular characteristic and its intensity is calculated for each pixel. This calculation step will be explained in more detail with reference to FIG. 4.

In step S21, gray-scaling is performed on the input image data. The input image data in primary colors R, G, B contains pixel data, called RGB values (R, G, B), for each pixel. The RGB values are converted into a pixel brightness for each pixel during gray-scaling. That is, the full-color image P1 is converted into a monochrome image.

In this embodiment, the brightness of a pixel is defined as one-half of the sum of the maximum value and the minimum value among the RGB values, and is within a range from 0 to 255. A brightness of 0 represents black, while a brightness of 255 represents white. For example, a pixel of RGB values (200, 100, 50) has a brightness of (200+50)/2=125. Nevertheless, gray-scaling could be performed in another way, for example, by defining the brightness of the pixel as the maximum data among the RGB values.

Figures 6A, 6B:
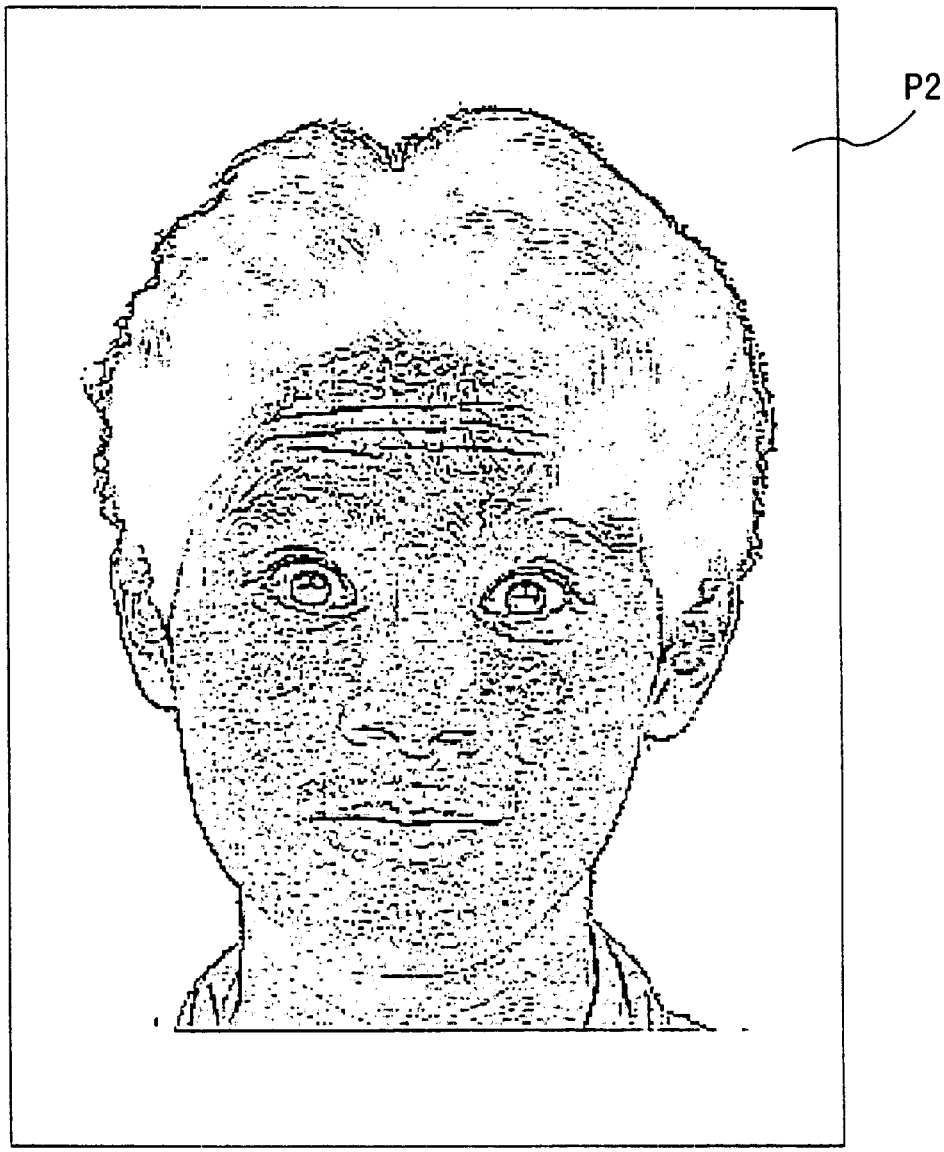
FIG. 6A shows Laplace transform operator.
FIG. 6B is an image, in reverse, after performing gray-scaling and Laplace transform on the image of FIG. 5.

Then, in step S22, a Laplace transform is performed on the gray-scaled image data. FIG. 6A shows a Laplace transform operator in this embodiment. FIG. 6B is an image P2, given in reverse video, after performing a Laplace transform by using the Laplace transform operators of FIG. 6B.

In step S23, the angular characteristic and its intensity are calculated for each pixel based on the Laplace-transformed image data. The angular characteristic indicates a direction of continuation of color gradation (namely, a direction in which the pixel values are continuous), while the angular characteristic intensity indicates a degree of color gradation. Herein, one pixel is taken as a designated pixel. In this embodiment, the angular characteristic of the designated pixel is calculated, while referring to the pixels located in N orbits around the designated pixel.

FIGS. 7A to 7E schematically show how the angular characteristic and its intensity are calculated for the designated pixel. To simplify the explanation, it is now assumed N=1. Namely, it is assumed that 3×3 pixels including the designated pixel at the center thereof are used for calculating the angular characteristic and its intensity, and that the each pixel data of 3×3 pixels has a brightness as shown in FIG. 7A.

Firstly, differences in brightness are calculated between any two adjacent pixel data. More specifically, a difference in brightness is calculated for each pixel data, and its right-hand neighboring pixel data, which form a pair of pixel data, as shown in FIG. 7B. The difference can not be calculated on the three pixel data located at the rightmost. The sum of the calculated differences becomes Sb=50+0+100+50+0+100=300. In the same manner, differences in brightness are calculated for each pixel data and its lower-right-hand neighboring pixel data, forming a second pair of pixel data (as shown in FIG. 7C); for each pixel data and its downside neighboring pixel data, (as shown in FIG. 7D); and for each pixel data and it lower-left-hand pixel neighboring pixel data, forming a fourth pair of pixel data, (as shown in FIG. 7E). The sums of the calculated differences become Sc=0, Sd=300, and Se=450, respectively.

Then, sums of horizontal components and of vertical components in the pixel data are calculated based on the sums Sb to Se. Herein, the horizontal components balance each other out along the lower-right direction and along the lower-left direction, while the vertical components balance each other out along the lower-right direction and along the lower-left direction.

A direction of the normal to the angular characteristic is calculated as an arc tangent of a ratio between the sums of the horizontal components and the vertical components. The direction of the normal to the angular characteristic indicates a direction in which the designated and referred pixel values are discontinuous. The direction of the angular characteristic is determined by adding 90 degrees to the direction of the normal to the angular characteristic. The direction of the angular characteristic indicates a direction in which the pixel values are continuous.

It is now defined that the lower-right direction indicates an angle from 0 to 90 degrees and the lower-left direction indicates an angle from 90 to 180 degrees. That is, the definition leads to that the upper-right direction falling at an angle from 0 to −90 degrees and the upper-left direction falling at an angle from −90 to −180 degrees.

When the sum Sc is larger than the sum Se, the direction of the normal to the angular characteristic is intended to point in the lower-right direction within 0 to 90 degrees (or, the upper-left direction within −90 to −180 degrees). Accordingly, a plus (+) sign is set to the components along the lower-right direction, and a minus (−) sign is set to the components along the upper-left direction. The sums of the horizontal components and of the vertical components are calculated by Sb+Sc−Se and Sd+Sc−Se, respectively.

On the other hand, when the sum Sc is smaller than the sum Se, the direction of the normal to the angular characteristic is intended to point in the lower-left direction with 90 to 180 degrees (or, upper-right direction with 0 to −90 degrees). A minus sign is set to the components along the upper-right direction, and a plus sign is set to the components along the lower-left direction. The sums of the horizontal components and of the vertical components are calculated by Sb−Sc+Se and Sd−Sc+Se, respectively. In this case, the ratio between the sums of the horizontal and the vertical components needs to be multiplied by −1, before calculating the arc tangent. This is because the arc tangent (the direction of the normal to the angular characteristic) is intended to fall with 90 to 180 degrees.

For example, because Sc<Se in FIGS. 7A to 7E, the sum of the horizontal components becomes Sb−Sc+Se=300−0+450=750 and the sum of the vertical components becomes Sd−Sc+Se=300−0+450=750. The arc tangent is determined as $\tan^{-1}\{-(750/750)\}=-45$ degrees. As described above, the arc tangent indicates the direction of the normal to the angular characteristic, and, in this example, is determined as a 135 degree angle toward the lower-left direction (a −45 degree angle toward the upper-right direction). Thus, in FIGS. 7A to 7E, the angular characteristic is determined as −45+90=45 degree angle toward the lower-right direction (−135 degree angle toward the upper-left direction). As illustrated in FIG. 7A and mentioned above, the pixel values are continuous in the direction of the angular characteristic, and are discontinuous in the direction of the normal to the angular characteristic.

Further, the angular characteristic intensity I is calculated by using the total sum S of the differences in brightness and the pixel data p of the designated pixel, by the following equation [1]. The total sum S of the differences in brightness is a sum of Sb, Sc, Sd and Se.

$$I = \frac{S \times (255 - p)}{255 \times (N \times 4)^2} \quad [1]$$

Wherein N is a number of orbits around the designated pixel (=1 in FIGS. 7A to 7E) and p is the pixel data of the designated pixel.

In the case of FIGS. 7B to 7E, the angular characteristic intensity I becomes as below.

$$I = \frac{(300 + 0 + 300 + 450) \times (255 - 100)}{255 \times (1 \times 4)^2} = 39.9$$

The angular characteristic and its intensity could be calculated in another way, for example, by applying Prewitt or Sobel operators to the gray-scaled image. FIGS. 8A and 8B respectively show Prewitt operators in the vertical direction and in the horizontal direction. FIGS. 8C and 8D respectively show Sobel operators in the vertical direction and in the horizontal direction. For instance, in the case of applying Sobel operators to a pixel located at a coordinate (X, Y), the angular characteristic C and its intensity I are calculated by the following equations [2] and [3].

$$C = \tan^{-1}\left(\frac{sy}{sx}\right) \quad [2]$$

$$I = \sqrt{(sx \times sx + sy \times sy)} \quad [3]$$

Wherein sx and sy result from applying the horizontal and vertical components of the Sobel operators (FIGS. 8C and 8D) to the pixel located at the defined coordinate (X, Y).

In step S3, line segment data is generated for each pixel based on the angular characteristic and its intensity. At least one embroidery stitch (such as running stitch) will be given along a line segment defined by the line segment data. The line segment data contains an angle component corresponding to a direction in which the line segment extends, a length component corresponding to a length of the line segment, and a color component corresponding to a color of the line segment. In the embodiment, the angle component is defined as an angle formed by the line segment with respect to the horizontal.

In the embodiment, the line segment data is first generated, including only the angle component and the length component. The angular component is set to the angular characteristic that has been calculated for each pixel in step S2. The length component is set to a fixed value that has previously been determined or an input value input by a user.

Figure 9:
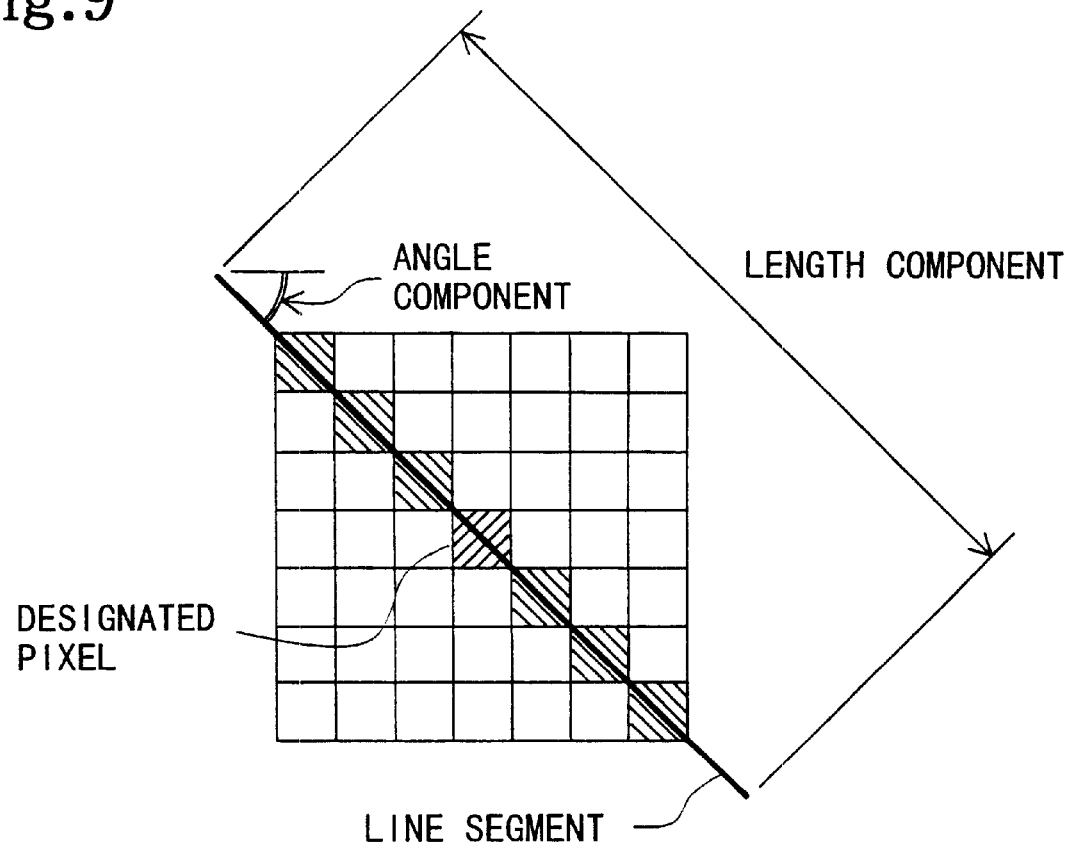
FIG. 9 schematically shows how line segment data defines a line segment on one pixel.

FIG. 9 schematically shows how the line segment data defines the line segment for one pixel. As shown in FIG. 9, the line segment data is generated so as to define the line segment with a given angle component and a given length component, centering on the designated pixel. In FIG. 9, the angle component represents 45 degrees.

If the line segment data is generated for all of the pixels, the embroidery data will have to have a plurality of line segment data, thereby giving an extremely large number of embroidery stitches along the line segments. Some of the embroidery stitches are repeatedly given at the same positions on a workpiece. This results in bad embroidery sewing quality. Also, when the line segment data is generated even on the pixel having a low angular characteristic intensity, the feature of the original image will not be reflected on the generated embroidery data.

Therefore, it is preferable to generate the line segment data successively only on the pixel having a higher angular characteristic intensity than a predetermined threshold value, while scanning all the pixels from the upper left. The threshold value is set to a fixed value that has previously been determined or an input value input by a user.

Figure 10:
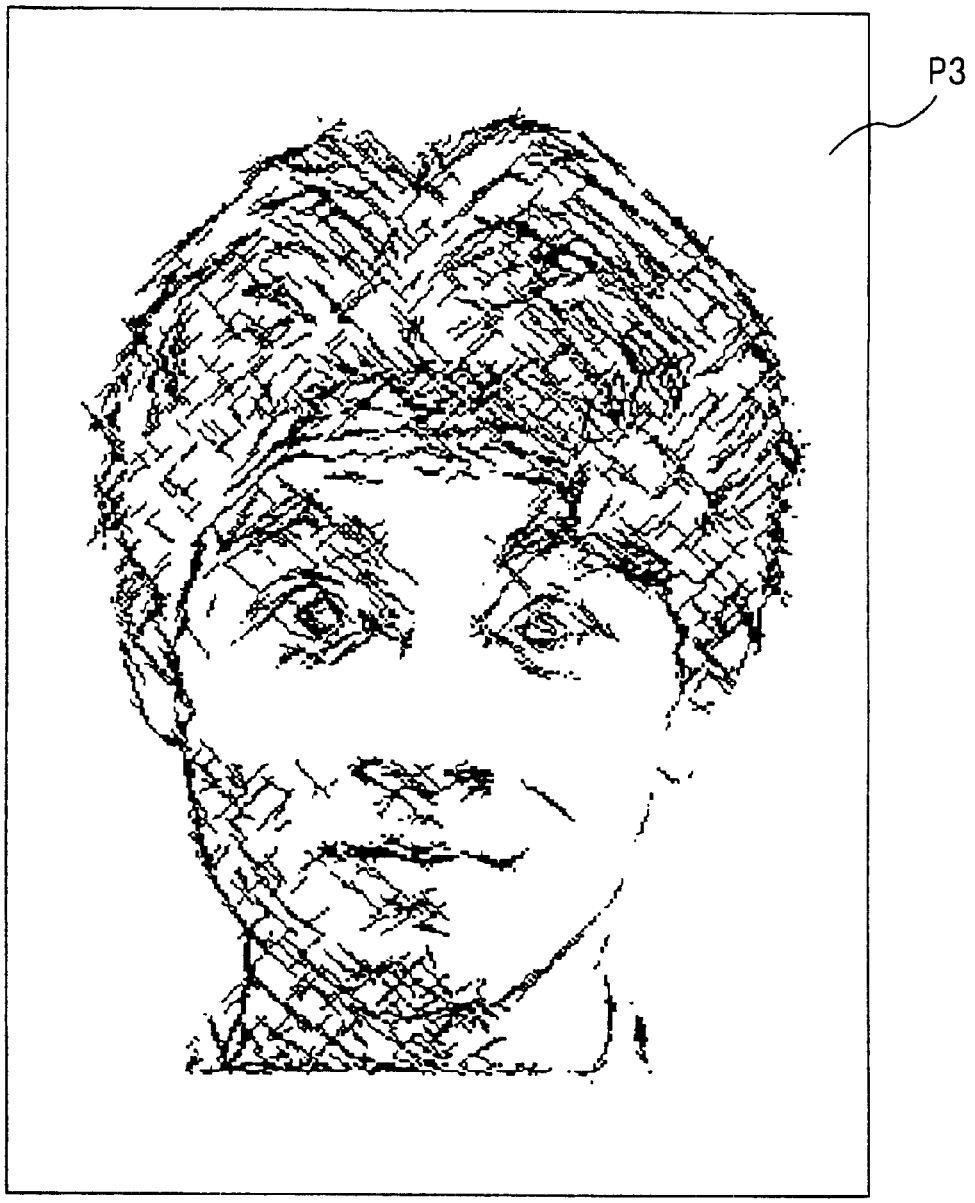
FIG. 10 is an image drawn with the line segments defined on the pixels having higher angular characteristic intensities than a threshold value.
Figure 11:
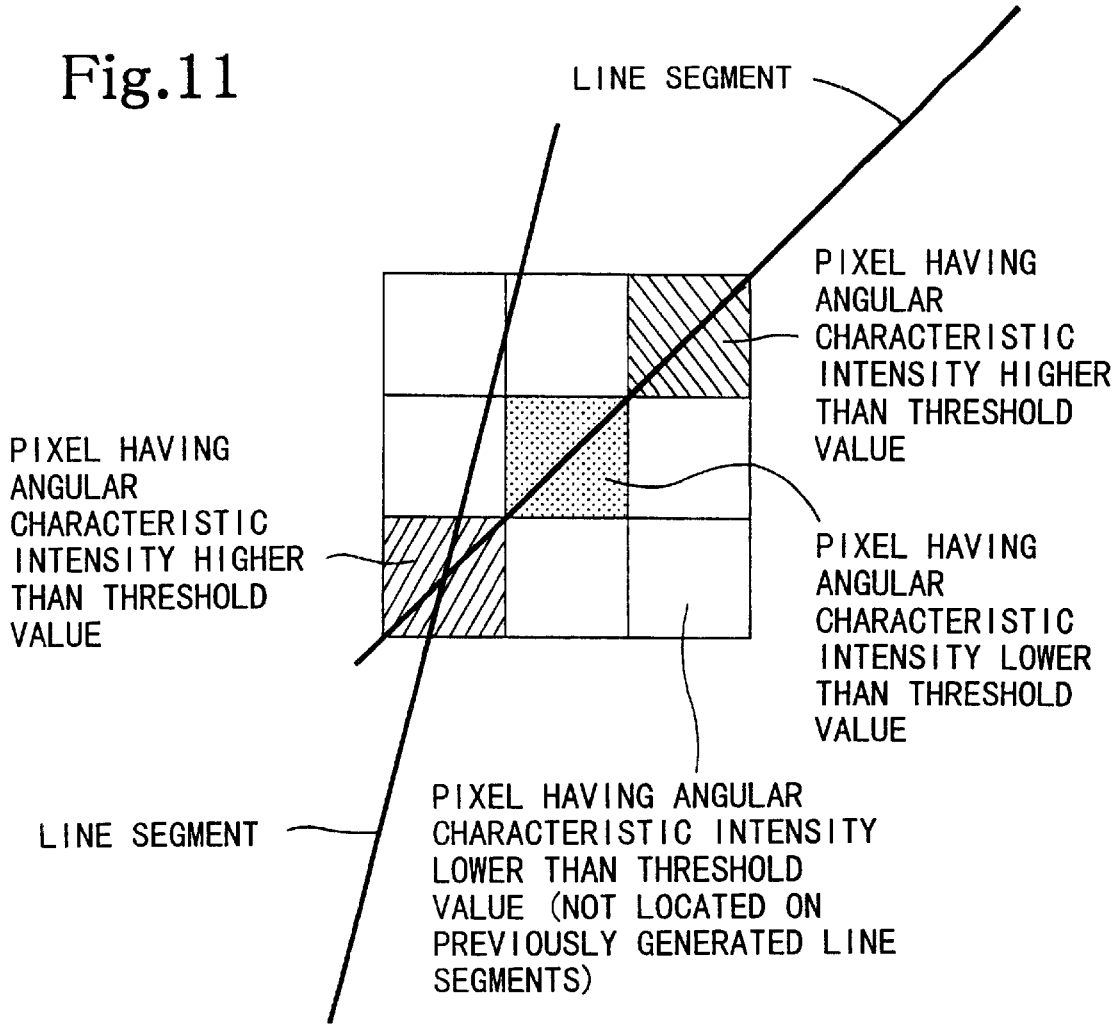
FIG. 11 schematically shows how the line segment data is generated.

FIG. 11 schematically shows how the line segment data is generated. As shown in FIG. 11, the line segment data is generated for the pixel having a higher angular characteristic intensity than the threshold value, even if the pixel falls on a line segment that has been generated for another pixel. FIG. 10 is an image P3 indicated by the line segments generated only for the pixels having higher angular characteristic intensities than the predetermined threshold value.

Then, the line segment data is also generated for the pixel (now called a designated pixel) that has a lower angular characteristic intensity than the threshold value and does not fall on the line segments that have been generated for other pixels. However, the angular characteristic will not be reflected properly on the line segment data, because its intensity is low. Thus, it is preferable to renew the angle component of the designated pixel, while referring to the pixels around the designated pixel. This makes it possible to generate a line segment that does not become incongruous in the image. On the other hand, the line segment data is not generated for the pixel that has a lower angular characteristic intensity and falls on the line segments that have already been generated for other pixels. This line segment data generation procedure will be explained below in more detail.

While scanning the pixels around the designated pixel, the pixels having higher angular characteristic intensities than the threshold value are selected. For the selected pixels, a sum S1 of products between the cosine of the angular characteristic and the corresponding angular characteristic intensity, and a sum S2 of products between the sine of the angular characteristic and the corresponding angular characteristic intensity are calculated. The angle component is newly defined as the arc tangent of a ratio of S2 to S1. The length component is set to the fixed value, as described above.

Figure 12:
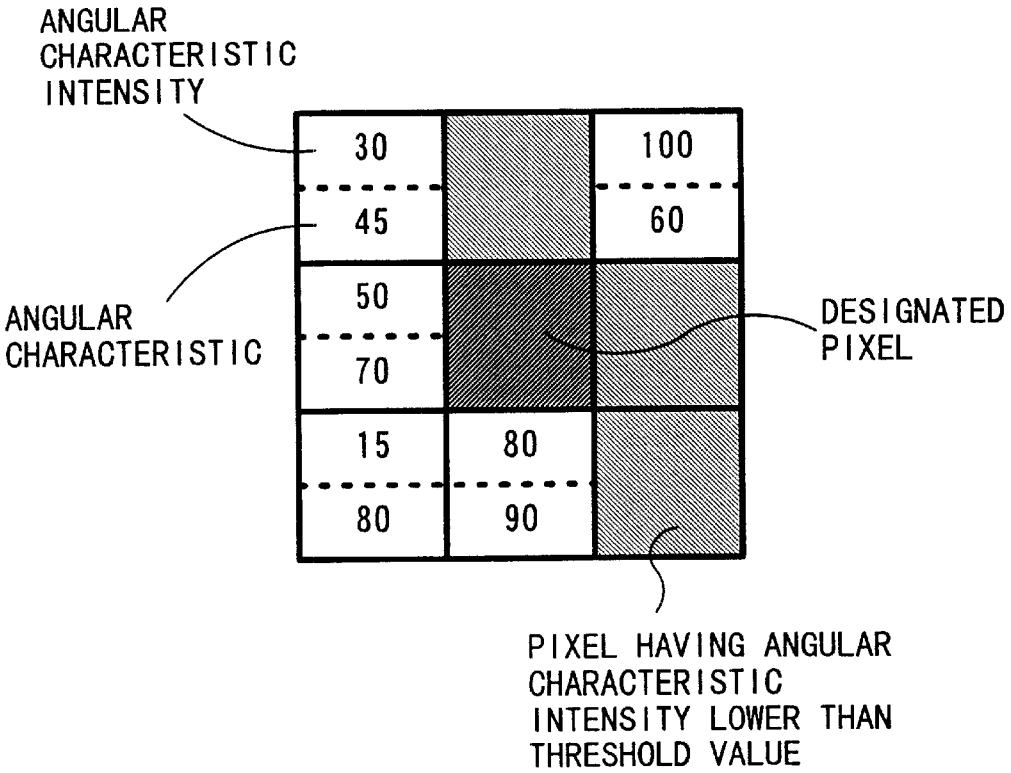
FIG. 12 schematically shows how an angle component is determined for a pixel having a lower angular characteristic intensity than the threshold value.

FIG. 12 schematically shows one example of a pixel group including a designated pixel that has a lower angular characteristic intensity than the threshold value and pixels located around the designated pixel. In FIG. 12, the diagonally shaded pixels have lower angular intensities than the threshold value. For example, the sums S1 and S2, and the arc tangent of S2/S2 are calculated as follows in FIG. 12.

$$S1=\cos(45)\times30+\cos(70)\times50+\cos(80)\times15+\cos(90)\times80+\cos(60)\times100=90.92$$

$$S2=\sin(45)\times30+\sin(70)\times50+\sin(80)\times15+\sin(90)\times80+\sin(60)\times100=249.57$$

$$\tan^{-1}(S2/S1)=\tan^{-1}(249.57/90.92)=70.02$$

Alternatively, the angle component could be renewed, for the pixel having a lower angular characteristic intensity than the threshold value, by limiting the angular component to a fixed value. The fixed value may have been previously preprogrammed, or be input by a user, In this case also, the line segment data is not generated for a pixel that has a lower angular characteristic intensity than the threshold value and falls on the line segments that have already been generated on other pixels.

Figure 13:
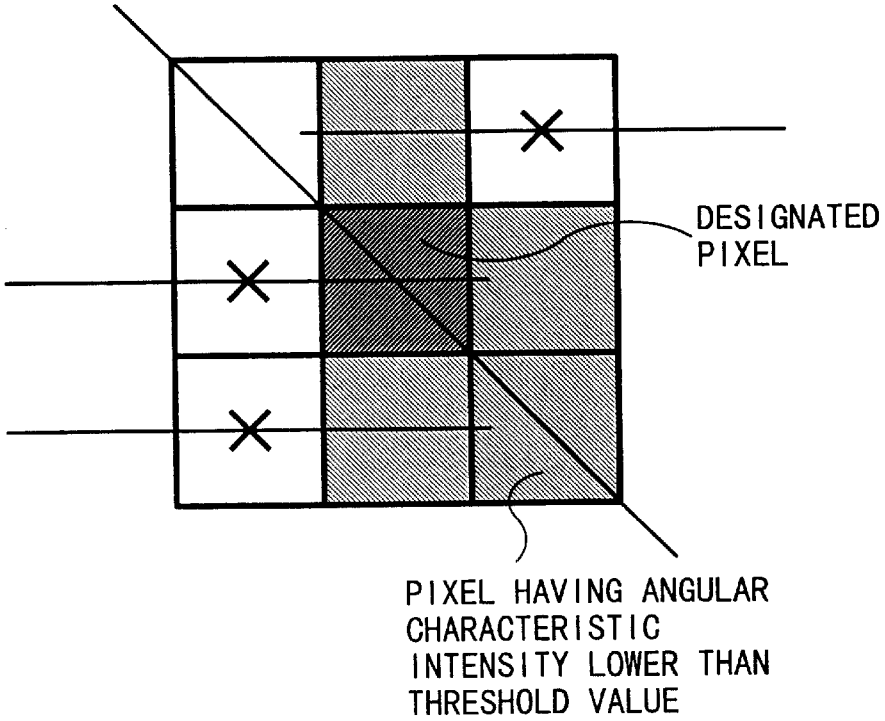
FIG. 13 schematically shows how the line segments are given, when the angle component of the pixel having the lower angular characteristic intensity is limited to a fixed direction.

FIG. 13 schematically shows how the line segments are given for the pixels having lower angular characteristic intensities than the threshold value, when limiting their angle components to the fixed value. In FIG. 13, the angle component is limited to the horizontal direction. As shown in FIG. 13, a line segment has already been provided diagonally on the designated pixel. The pixels marked with crosses have lower angular characteristic intensities than the threshold value. Thus, the line segments are given along the horizontal directions on the cross-marked pixels. The diagonally shaded pixels also have lower angular characteristic intensities than the threshold value, but no line segments will be given on the diagonally shaded pixel because, if the line segments are given on the diagonally shaded pixels, the thus-given line segments will overlap with the line segments that have previously been generated.

In addition, the possibility that the line segments overlap each other is increased by limiting the angle components to the fixed value. As described later, the overlapping line segments are combined into one, so as to reduce the number of line segments (that is, the number of embroidery stitches in the embroidery).

Next, in step S4, the line segment data is deleted if it is judged that the data is inappropriate or unnecessary for generating the embroidery data. The line segment data deletion procedure will be explained below in greater detail with reference to FIG. 14. The data deletion procedure is performed for all the pixels, while referring to the pixels from the upper left successively.

Figure 14:
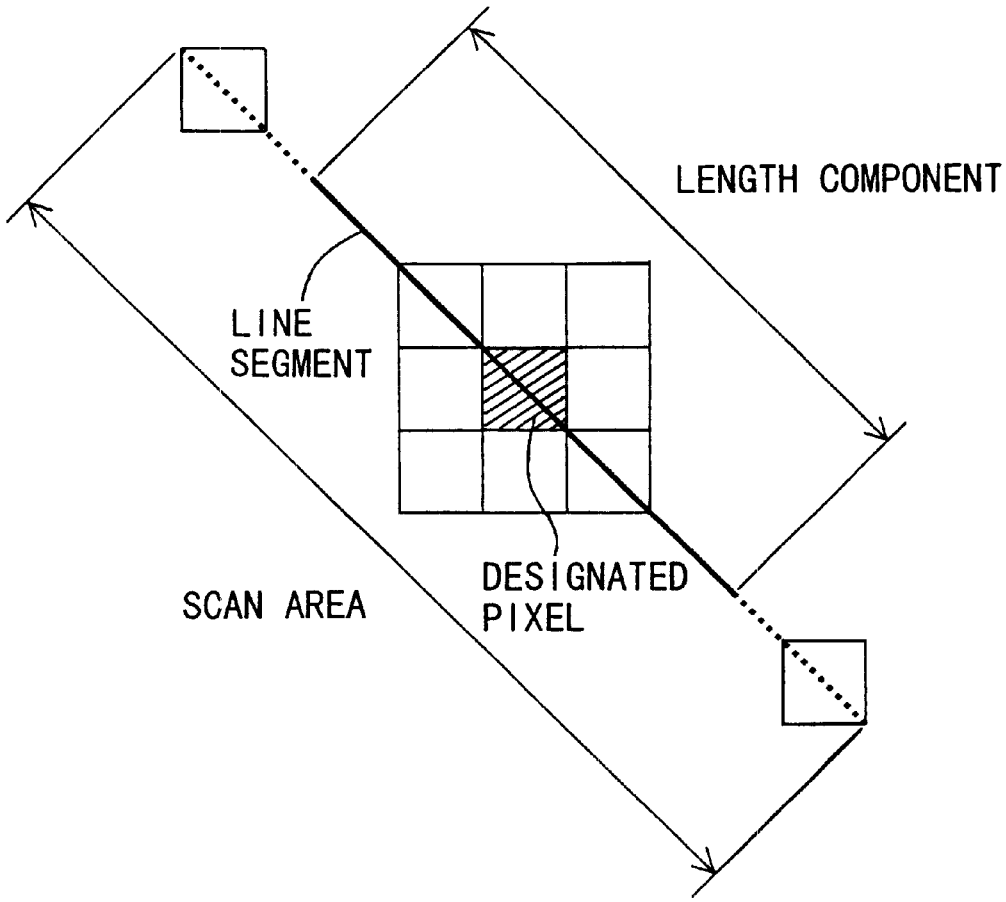
FIG. 14 schematically shows how the line segment data, generated on the pixel having the angular characteristic similar to a designated pixel, is deleted.

FIG. 14 schematically shows how the line segment data is deleted. As shown in FIG. 14, pixels are scanned on a continuation of the line segment generated for the designated pixel within a predetermined scan area. If any of the scanned pixels has a similar angular characteristic to the designated pixel and has a lower angular characteristic intensity than the designated pixel, the line segment data of the scanned pixel is deleted. On the other hand, if the scanned pixel has a similar angular characteristic as the designated pixel, but has a higher angular characteristic intensity than the designated pixel, the line segment data of the designated pixel is deleted.

In this embodiment, the scan area is defined as an area of n times the length component of the designated pixel. Also, it is judged that the scanned pixel has a similar angular characteristic to the designated pixel when a difference in the angular characteristics falls within a predetermined variation (plus or minus θ). These factors n and θ are set to fixed values that have been previously determined or to input values input by a user.

Figure 26A:
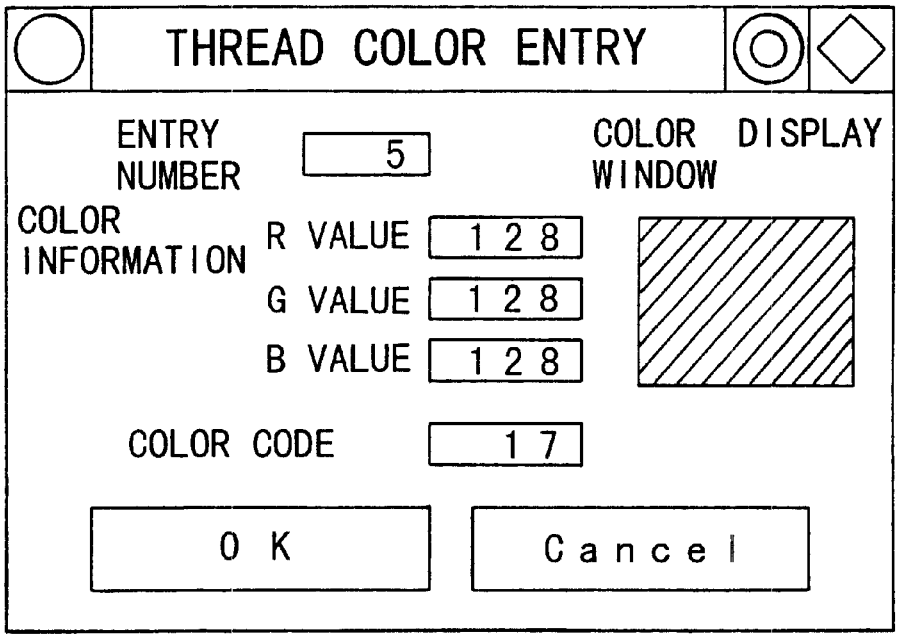
FIG. 26A shows a screen called up for inputting thread color information and color code.
Figure 26B:
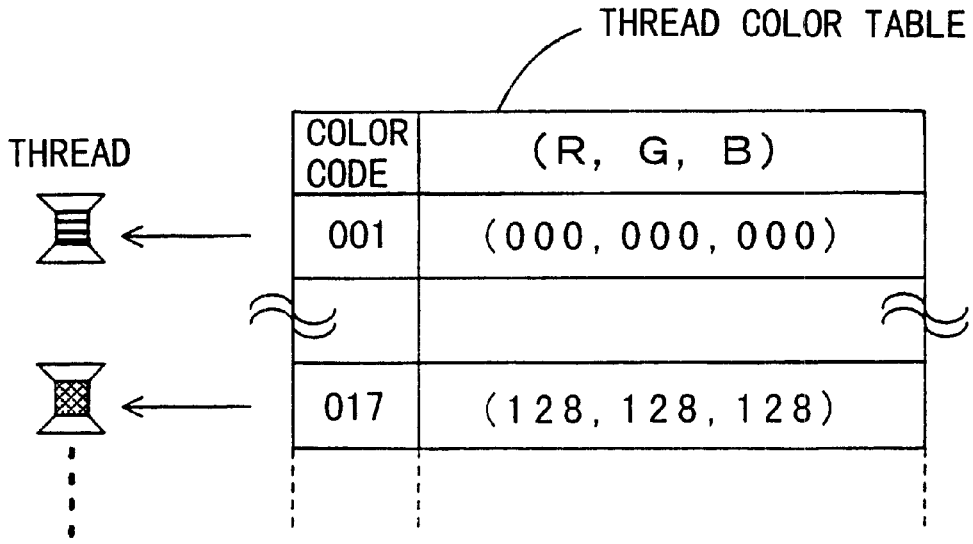
FIG. 26B shows a thread color table.

In step S5, the color component is determined for each line segment data. In advance of determining the color components, a number of thread colors needs to be entered. FIG. 26A shows a screen called up for inputting thread color information and color code. FIG. 26B shows a thread color table. The thread color information and the color code are input for each input thread color using the screen of FIG. 26A, thereby producing the thread color table of FIG. 26B. Simultaneously, a sequence for changing thread colors is designated. The sequence of thread colors could be designated by a user or be predetermined.

Then, a conversion image is prepared having the same size as the original image. To draw a line segment for one designated pixel into the conversion image, reference areas are specified for the designated line segment on the original image and on the conversion image, respectively.

Figure 15A:
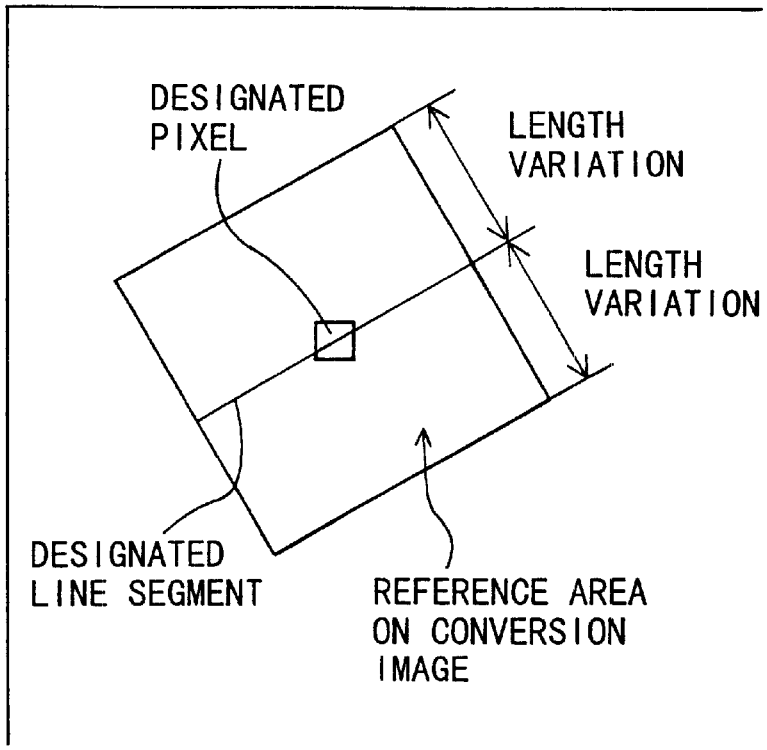
FIGS. 15A and 15B show reference areas to be referred to for determining a color component of the line segment data.
Figure 15B:
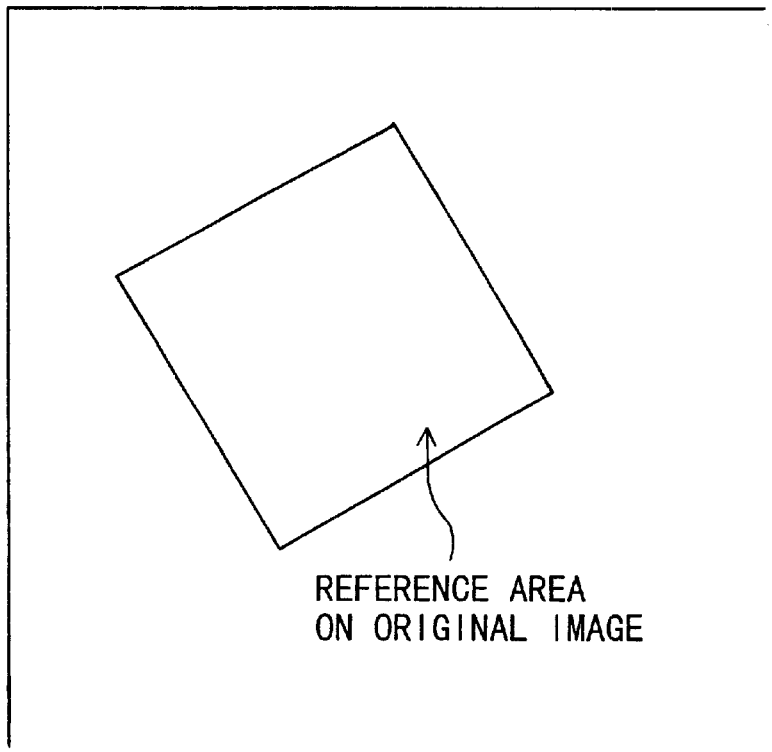

FIGS. 15A and 15B shows the reference areas defined on the conversion image and on the original image, respectively. In this embodiment, the reference area is defined by two rectangular areas sandwiching the designated line segment therebetween. Further, each of the rectangular areas is defined by a length variation extending in a direction of the normal to the designated line segment, as shown in FIG. 15A. This reference area could be designated by a user or be predetermined.

Concerning one reference area on the conversion image, a sum Cs1 of RGB values for all the pixels within the reference area is calculated. Herein, the number of pixels used for calculating the sum Cs1 is referred to as d1. Not included, in this calculation, are pixels on which line segment data has not been generated, i.e., the pixels on which line segments are not to be drawn. The number of the pixels on which line segments are to be drawn is referred to as s1. Also, a sum Cs2 of RGB values of all the pixels within the reference area on the original image is calculated. The number of pixels used for calculating the sum Cs2 is referred to as d2.

The following equation [4] holds, while a color of the pixels on which the line segments are to be drawn is referred to as CL.

$$\frac{Cs1 + CL \times s1}{s1 + d1} = \frac{Cs2}{d2} \qquad [4]$$

The equation [4] means that the reference area on the conversion image has the same color average as the reference area on the original image. Thus, the color CL is determined based on the sums Cs1 and Cs2 and the numbers s1, d1 and d2 by using the equation [4].

Finally, one of the input thread colors is selected to be closest to the calculated color CL, and is determined as the color component on the designated line segment. More specifically, the tread color is selected by finding a minimum distance in RGB space between the input thread color and the calculated color CL. The distance in RGB space is indicated by the following equation [5], while the RGB values of the calculated color CL and of the thread color are defined as (ro, go, bo) and (rn, gn, bn), respectively.

$$d=\sqrt{(ro-rn)^2+(go-gn)^2+(bo-bn)^2} \qquad [5]$$

Figures 16A, 16B, 16C:
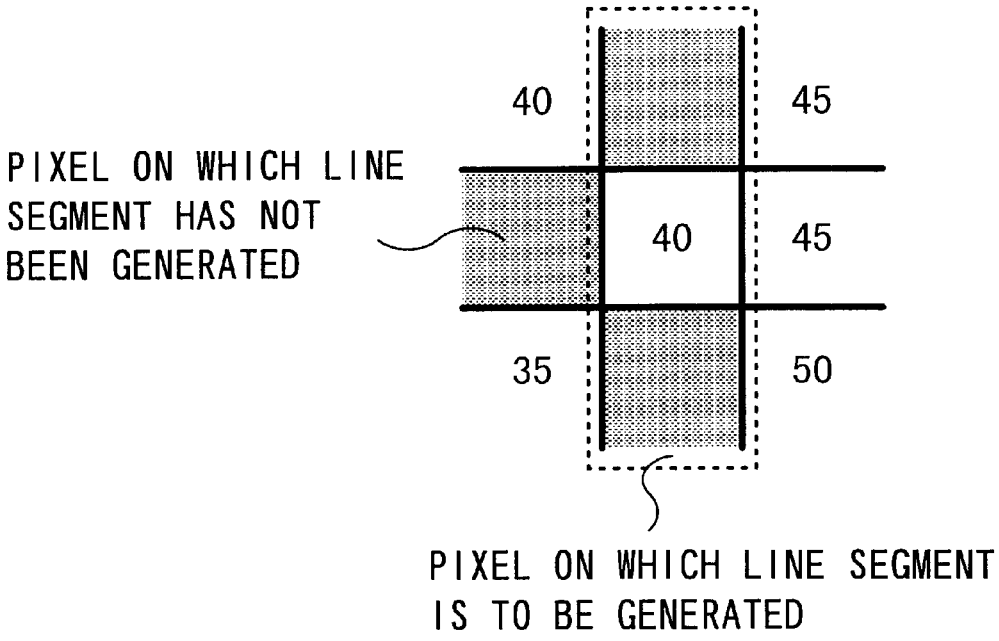
FIGS. 16A to 16C schematically show how the color component is determined.

The calculation of color component will be explained in more detail by citing the example of FIGS. 16A to 16C. FIGS. 16A to 16C schematically show how the color component is determined. To simplify the explanation, the pixel brightness is used herein in place of the RGB value. Also, the reference area includes 3×3 pixels only for explanation purposes.

When the pixels located within the reference area have brightnesses as shown in FIGS. 16A and 16B on the conversion image and on the original image (before drawing the designated line segment), respectively, the sums Cs1 and Cs2 and the numbers d1, d2 and s1 are determined as follows.

Cs1=40+35+45+45+50=215 d1=5

Cs2=30×3+20×3+40×3=270 d2=9 s1=3

Thus, the color CL is calculated, by using the equation [4], from the sums Cs1 and Cs2 and the numbers d1, d2 and s1. The calculation result is shown as below.

$$CL=\{(Cs2\div d2)\times(s1+d1)-Cs1\}\div s1=\{(270\div 9)\times(3+5)-215\}\div 3\cong 8.3$$

After drawing the line segment in the color CL of 8.3 on the above-designated pixel in the conversion image, the pixels have a brightness as shown in FIG. 16C within the reference area on the conversion image. As mentioned above, the average of brightness within the reference area on the conversion image is the same as that on the original image. The thread color is determined, for the designated pixel, to be closest to the calculated color CL of 8.3 based on the equation [5].

Figure 27:
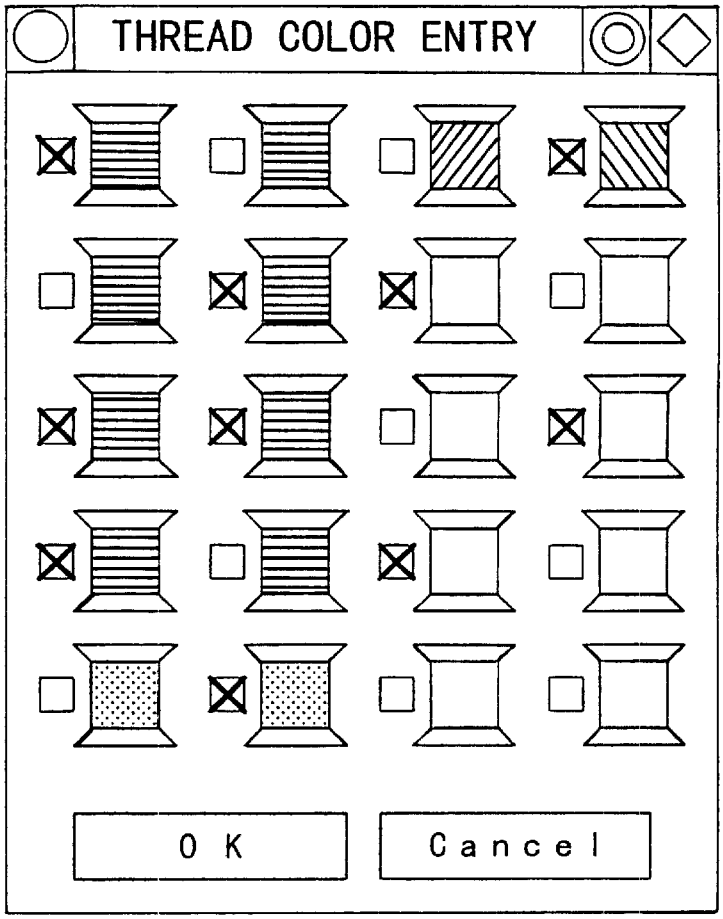
FIG. 27 shows a screen called up for selecting thread colors.
Figure 28:
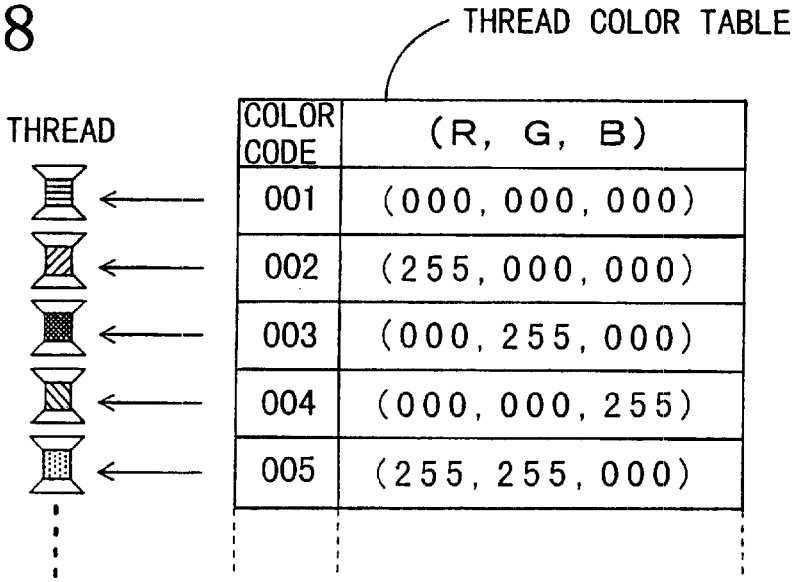
FIG. 28 shows another thread color table.

In this embodiment, the thread color table is produced by inputting thread colors to be used together with the corresponding color codes. However, the thread color table could be preprogrammed. FIG. 27 shows one example of a thread color selection screen based on previously entered data. In such a case, the thread colors to be used are selected by a user from the thread color selection screen to create a thread color table (FIG. 28).

Figure 17A:
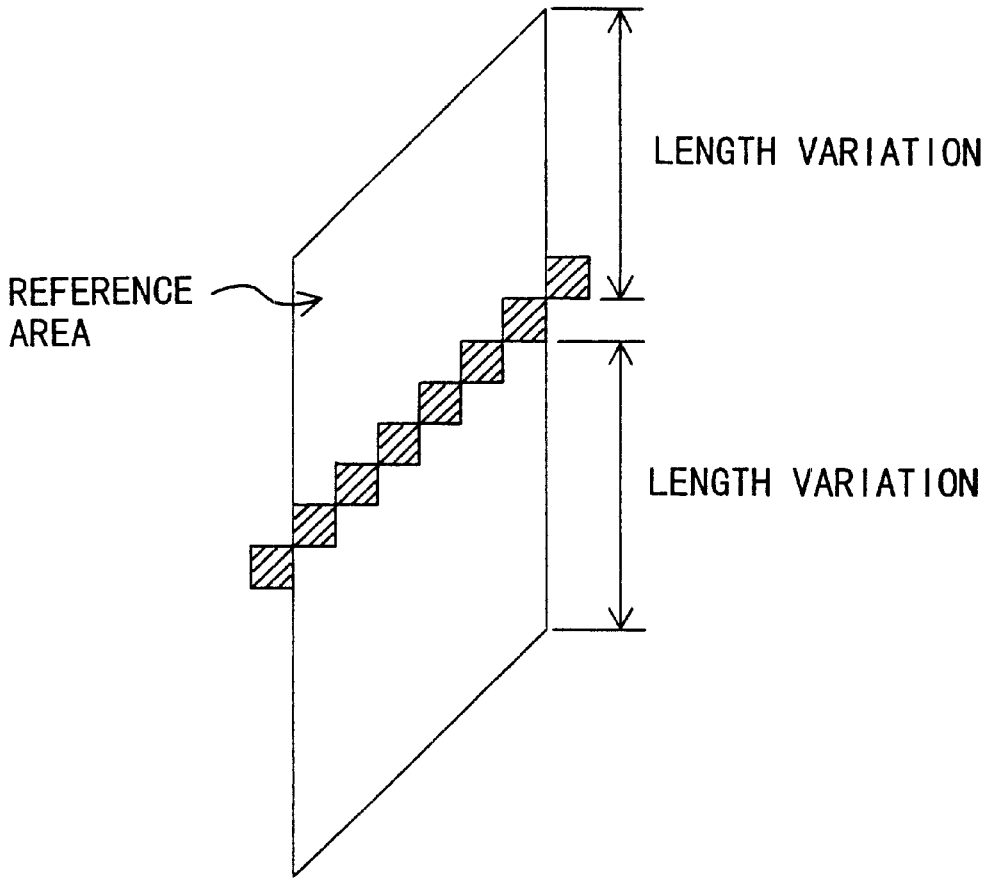
FIGS. 17A and 17B show other reference areas to be referred to for determining the color component.
Figure 17B:
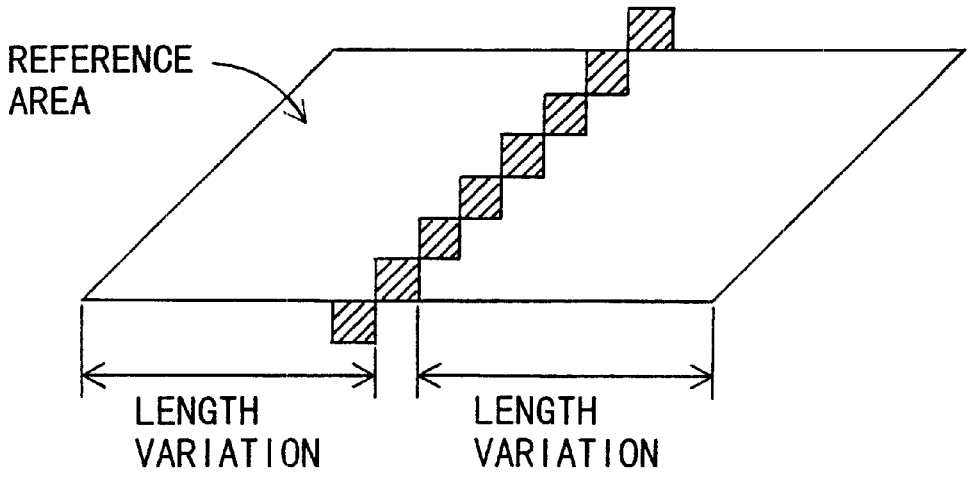

Further, in this embodiment, the reference area is defined by the two rectangular areas sandwiching the designated line segment with the length variations therefrom. However, the reference area may be defined in another way, for example, as shown in FIGS. 17A and 17B. FIGS. 17A and 17B show the reference areas defined in a different way from that described above. If the angle component is within a range from 0 to 45 degrees or from 135 to 180 degrees, the reference area can be defined by two parallelograms with the length variations along the vertical direction, as shown in FIG. 17A. On the other hand, if the angle component is within a range from 45 to 135 degrees, the reference area can be defined by two parallelograms with the length variations along the horizontal direction, as shown in FIG. 17B.

Figure 18A:
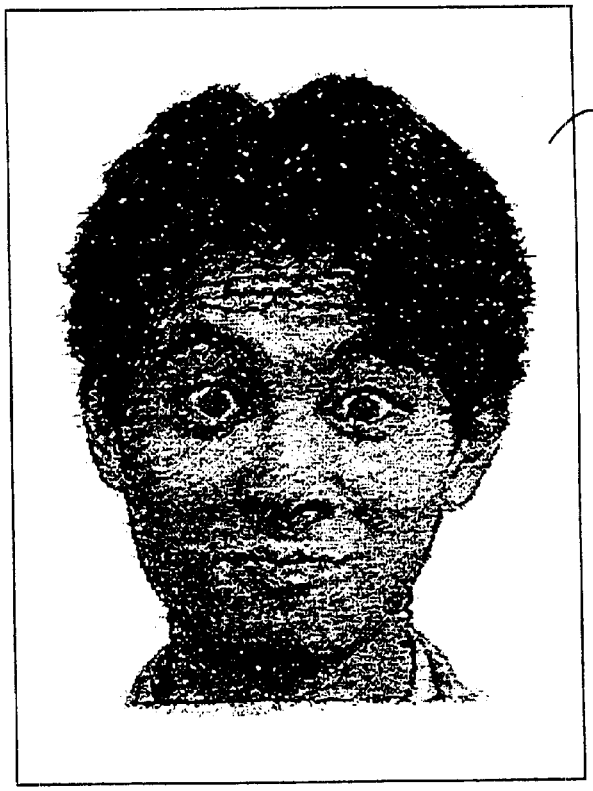
FIGS. 18A and 18B are images given by determining the color components of the line segments, respectively, while referring to colors around the line segments and while not referring to colors around the line segments.
Figure 18B:
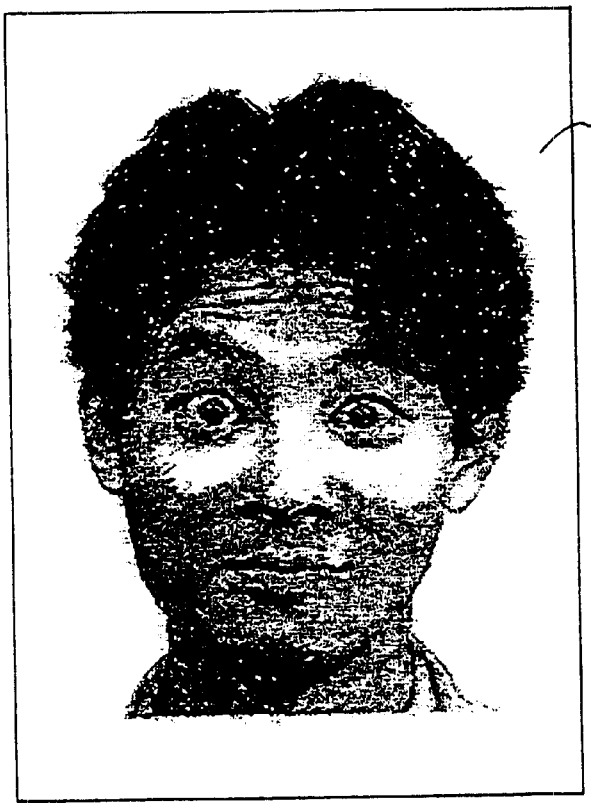

Now, FIGS. 18A and 18B are images P4 and P5 given by determining the color components of the line segments, respectively, while referring to colors around the line segments and while not referring to colors around the line segments. According to the above-described embodiment, the conversion image P4 is colored in true-to life, subtle gradation of colors and, therefore, resembles the original image P1 very closely. On the other hand, the conversion image P5 is colored in an unsubtle gradation of colors, and its gradation sequence is discontinuous.

In step S6, the line segment data is reshaped by combining and/or deleting the line segments, while referring to all of the angle, the length and the color components.

Figure 19A:
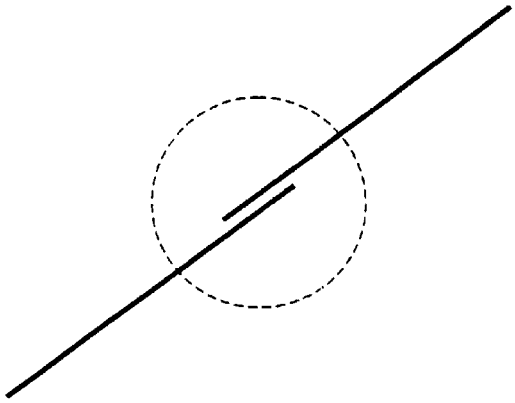
FIGS. 19A and 19B schematically show how two line segments, having the same angle and color components and overlapping each other, are combined into one line segment.
Figure 19B:
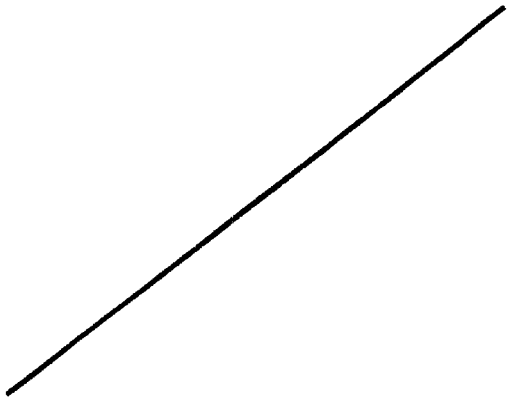

FIGS. 19A and 19B schematically show how two line segments are combined into one. In FIG. 19A, two line segments are illustrated to be shifted (only for explanation purposes), but actually are placed collinearly and overlap one another. If any two line segments have the same angle component and color component and overlap one another, as shown in FIG. 19A, the line segments are combined into one as shown in FIG. 19B.

This allows reducing the number of stitches in the embroidery and, at the same time, generating the embroidery data for efficient embroidery sewing operation, without deteriorating the embroidery sewing quality.

Figure 20:
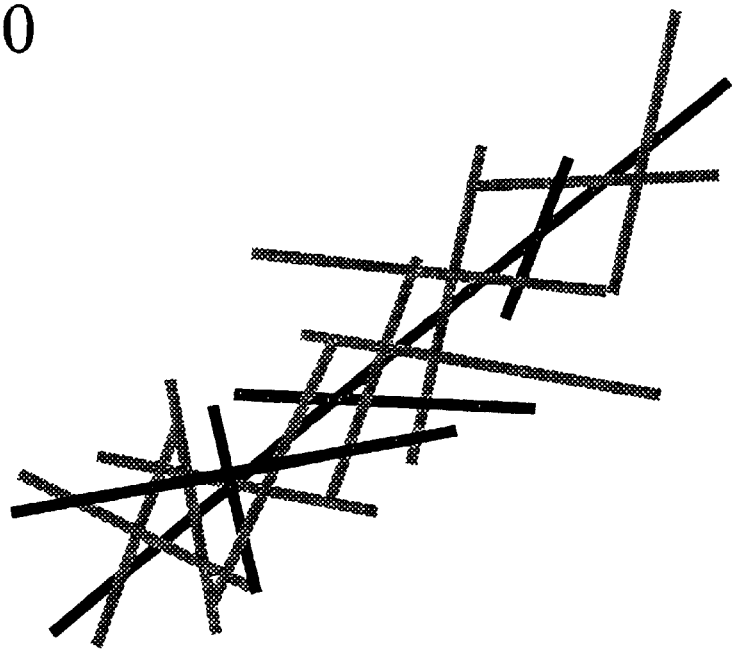
FIG. 20 illustrates one line segment of one thread color overlapped with a plurality of line segments of other thread colors.

FIG. 20 shows the line segments of different color components. As shown in FIG. 20, the line segments of one color component may be covered with the subsequent line segments of other color components. In this case, an exposing rate is calculated for the covered line segment. When the exposing rate is smaller than a threshold value (referred to as minimum exposing rate), the covered line segment is deleted. Herein, the minimum exposing rate could be predetermined or input by a user. This also allows reducing the number of stitches in the embroidery by deleting insignificant line segments and generating the embroidery data for efficient embroidery sewing operations, without deteriorating embroidery sewing quality.

The embroidery data is generated in step S7, based on the line segment data that has been generated in steps S3 to S6. Principally, the embroidery data is generated, for every thread color, by converting a starting point and an ending point of each line segment and its color component into a starting point and an ending point for providing at least one embroidery stitch and its thread color, respectively.

However, if all the line segments are converted into distinct stitches, there will be provided feeding stitches between any two line segments. That is, feeding stitches are provided to go from one line segment to the following line segment. Further, there are also provided tacking stitches for each end of each line segment. Deterioration in the embroidery sewing quality is caused by such a large number of feeding stitches and tacking stitches. It is therefore preferable to convert the line segments into the sequential stitches according to the following procedure.

The line segments are divided into a plurality of groups by the color component. While scanning any one of the groups of line segments, one line segment is specified as a first line segment, having one end located at the upper-leftmost. The one end is set as a starting point of the first line segment, while the other end is set as an ending point of the first line segment. While further scanning the rest of the line segments in the group, another line segment is specified as a second line segment, having one end located nearest to the ending point of the first line segment. The one end is set as a starting point of the second line segment, while the other end is set as an ending point of the second segment. In this manner, the line segments are put in a sequential order in each group, so that the nth line segment has the starting point and an ending point located nearest to an ending point of n−1th line segment and a starting point of n+1th line segment, respectively.

The line segments that have been put in a sequential order are converted into sequential embroidery stitches. This leads to providing a feed stitch between two sequential line segments, thereby jumping from one line segment to the subsequent line segment. However, some of the feeding stitches are converted into running stitches according to the following procedure.

Based on the sequences of thread colors determined in step S5, it is then examined whether any feeding stitch of one thread color is to be covered with the embroidery stitches of the subsequent thread colors. The feeding stitch of any thread color is converted into the running stitches if it is to be covered with the embroidery stitches of the subsequent thread colors.

More specifically, while referring to any one feeding stitch, pixels are specified on the conversion image as located over the referred feeding stitch. Then, it is determined whether there are any line segments on the specified pixels, corresponding to the subsequent thread colors to the thread color of the referred feeding stitch. If any such line segments are found, the referred feeding stitch is converted into the running stitches.

Alternatively, one feeding stitch of any thread color may be converted into the running stitches, while calculating a total sum CC of color difference along the feeding stitch. In this case, there is provided a counter in the controller 10 for calculating the total sum CC. The counter is set to "0" in its initial state. As described above, when referring to any one feeding stitch, pixels are specified on the conversion image, as located over the referred feeding stitch. Then, the specified pixels are scanned successively.

The counter does not increment, when a scanned pixel corresponds to the subsequent thread color to the thread color of the referred feeding stitch. On the other hand, when the scanned pixel corresponds to the preceding thread color to the thread color of the referred feeding stitch, the counter increments by a color distance in RGB spaces between the referred feeding stitch group and the scanned pixel. The total sum CC of color difference is calculated from the incremented values counted by the counter. If the total sum CC is smaller than a predetermined threshold value, the referred feeding stitch is converted into running stitches. The threshold value may be a fixed value that has been previously set, or an input value input by a user.

As described above, in this embodiment, it is judged whether to convert the feeding stitches into running stitches, after all the line segments are put in a sequential order, such that nth line segment has a starting point located nearest to an ending point of n−1th line segment. However, it is also possible to put the line segments of one thread color in a sequential order, while judging whether to convert the feeding stitch into the running stitches.

For example, after specifying the n−1th line segment, all paths are checked between the ending point of the n−1th line segment and both ends of possible nth line segments. If any one path is found to be covered with the embroidery stitches of different thread colors (namely, the feeding stitch along the found path can be converted into the running stitches), the line segment, leading to the found path, can be specified as the nth line segment.

Or, after specifying the n−1th line segment of one thread color, a point is found where the total sum CC is smaller than the threshold value. The line segment, having one end at the found point, can be specified as the nth line segment.

Figure 21:
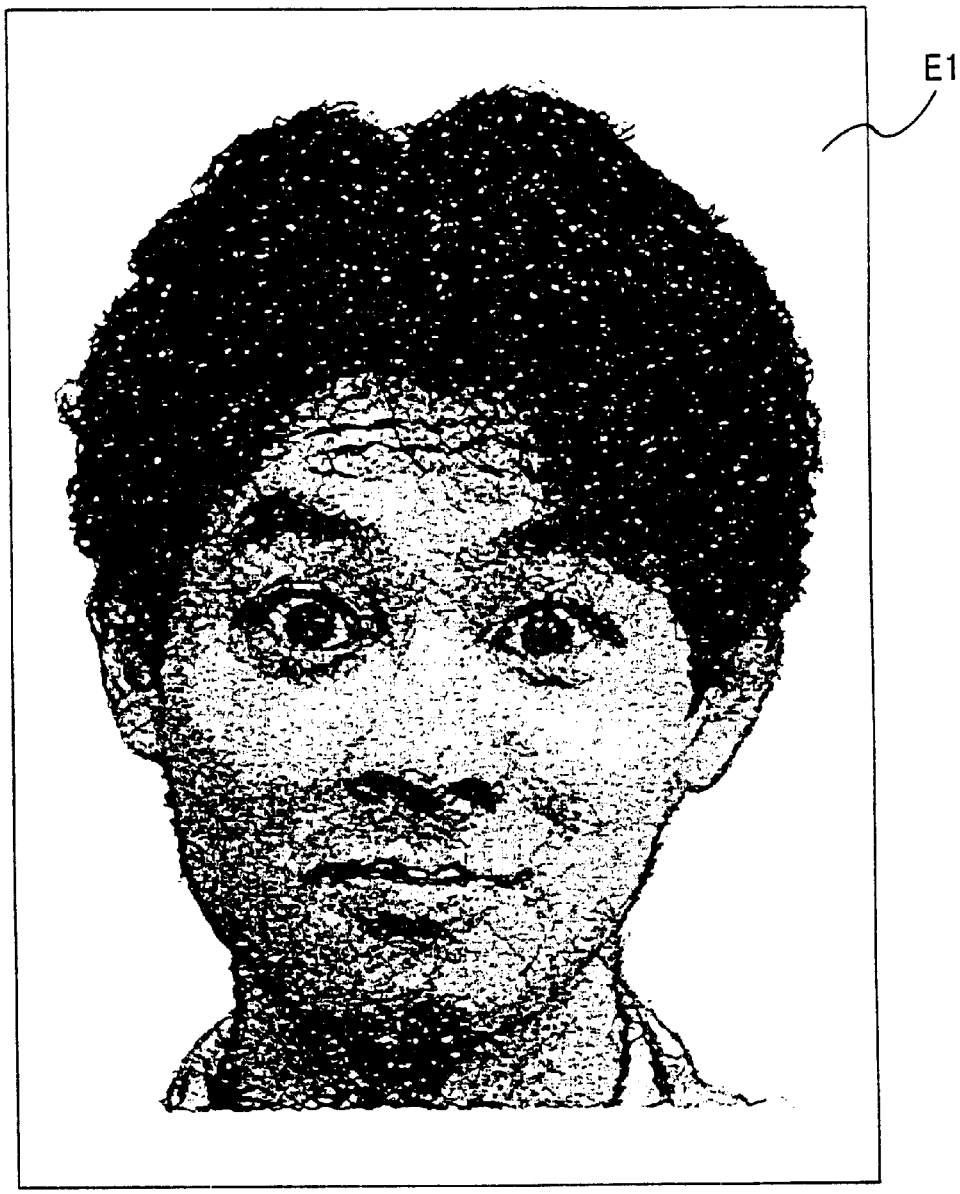
FIG. 21 is an embroidery formed based on the embroidery data according to the invention, by renewing the angular characteristics of the pixel having the lower angular characteristic intensities with reference to their surrounding pixels.
Figure 22:
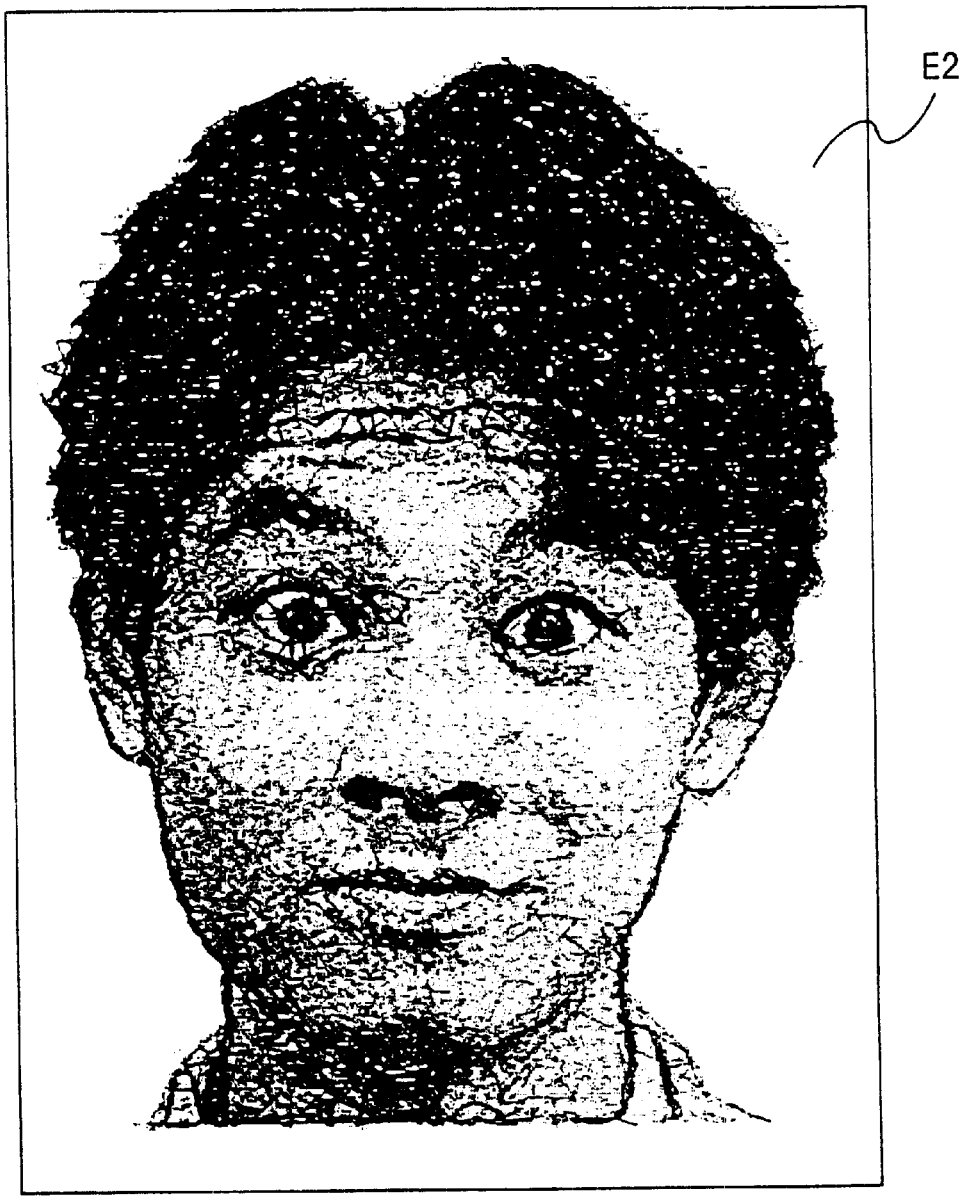
FIG. 22 is an embroidery formed based on the embroidery data according to the invention, by limiting, to the fixed value, the angular characteristics of the pixel having the lower angular characteristic intensities.
Figure 23:
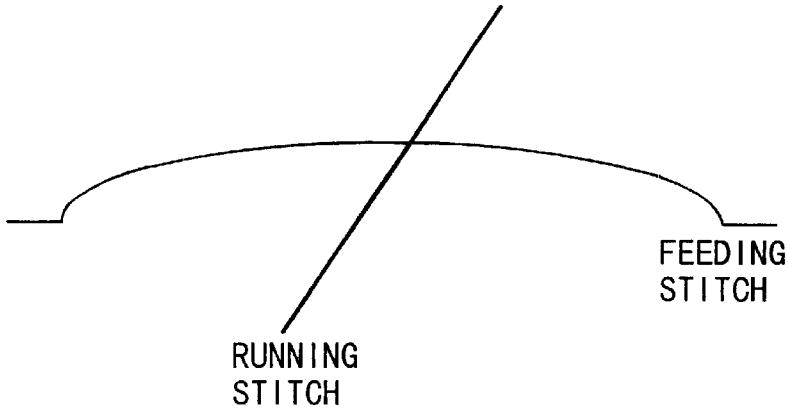
FIG. 23 illustrates running stitches given over a feeding stitch.

FIGS. 21 and 22 are embroideries E1 and E2 formed based on the embroidery data that have been generated in steps S1 to S7 according to the invention. The embroidery E1 is based on the embroidery data generated by renewing, in step S3, the angular characteristics of pixels that have lower angular characteristic intensities than the threshold value with reference to their surrounding pixels. The embroidery E2 is based on the embroidery data generated by limiting, to the fixed value, the angular characteristics of pixels that have lower angular characteristic intensities in step S3. The embroideries E1 and E2 resemble the original image P1 (FIG. 5) very closely.

Figure 30A:
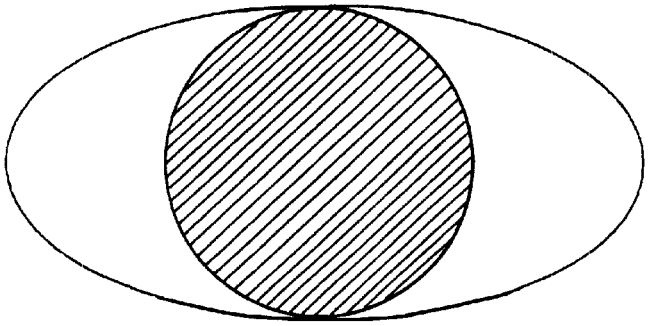
FIG. 30A shows another example of an original image.
Figure 30B:
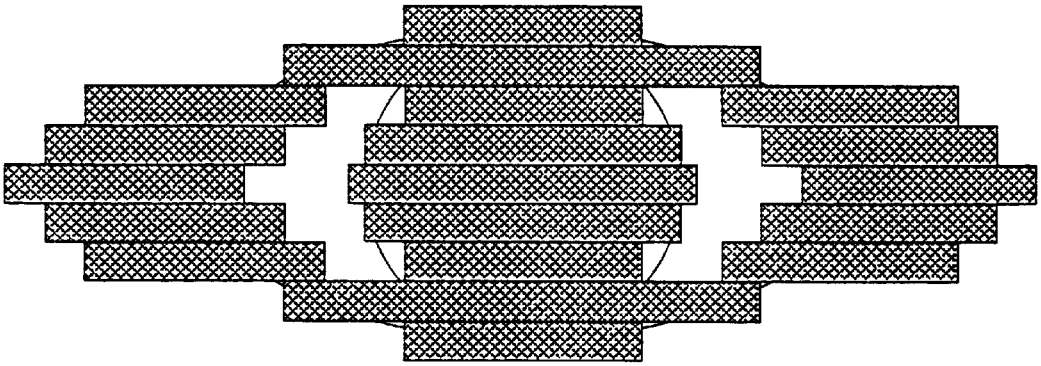
FIG. 30B schematically shows stitches given on a workpiece based on embroidery data generated by a conventional embroidery data generating apparatus.
Figure 30C:
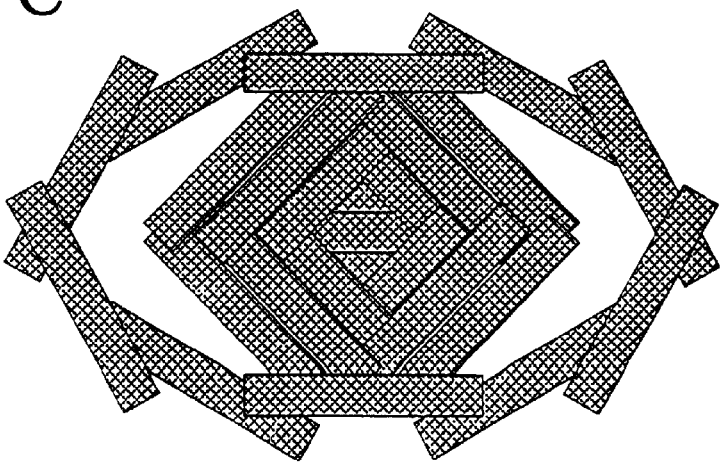
FIG. 30C schematically shows stitches given on a workpiece based on embroidery data generaated by the embroidery data generating apparatus of the invention.

FIG. 30A shows another example of an original image. FIGS. 30B and 30C schematically illustrate stitches given based on embroidery data generated by a conventional embroidery data generating apparatus and the embroidery data generating apparatus 1 of the invention, respectively. As shown in FIGS. 30B and 30C, it is apparent that the embroidery data generating apparatus 1 of the invention generates the embroidery data for forming an embroidery that resembles the original image much more closely than the conventional embroidery data generating apparatus.

It is conceivable, for any one thread color, that the embroidery stitches and/or the running stitches may be given over the feeding stitches, in the case where the sequence of line segments is determined in the above-described manner. In such a case, if a sewing machine does not have the function of automatically cutting and removing the feeding stitches, the sewing machine has to cut the feeding stitches after giving all the stitches. It is difficult to cut the feeding stitches under the running stitches. Therefore, it is preferable to determine the sequence of line segments, so that the feeding stitches do not lie under the embroidery stitch and/or the running stitches in the same thread color.

More specifically, while determining the sequence of line segments for each thread color, the line segments that have already been put in a sequential order are marked on the conversion image (for example, by setting the corresponding pixels in white). It is now assumed that up to n−1th line segments have put in a sequential order and marked on the conversion image. Before specifying the nth line segment, a path is checked between the n−1th line segment and a possible nth line segment. And, it is judged whether there is any line segment that is not marked, (namely, not put in a sequential order) across the checked path. If such a line segment is found, the possible nth line segment is passed over. That is done because, if the possible nth line segment is formally specified as the nth line segment, the feeding stitch between the n−1th line segment and the specified nth line segment will lie under the embroidery stitches.

Further, it is desired to make a number of oversewing uniform for each pixel, so as to avoid deterioration in the embroidery sewing quality. It is therefore preferable to perform the following process, when generating the line segment data in step S3. For that purpose, there is a counter for each pixel in the conversion image, for counting a number of line segments passing through the corresponding pixel.

The line segment data is generated for a pixel having a higher angular characteristic intensity, while the counters increment by 1 for pixels over a line segment of the generated line segment data. When generating next line segment data, all the counters are checked to determine whether the sum of counted numbers of all the counters is larger than a threshold number. If the sum of counted numbers is larger than the threshold number, the line segment data at the time of generating is canceled. The threshold number may be a fixed number that has previously been determined, or an arbitrary number input by a user. This allows reducing the number of oversewing on each pixel, thereby providing excellent sewing quality.

Figure 24:
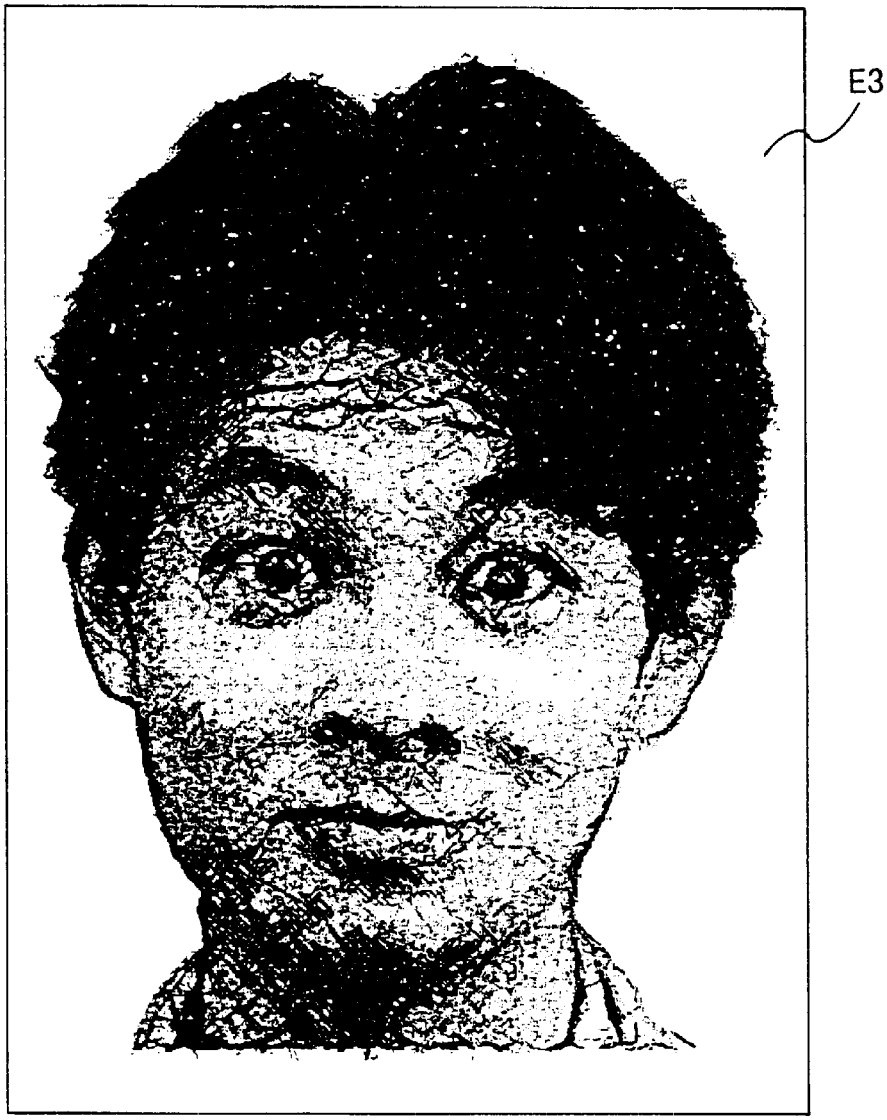
FIG. 24 is an embroidery formed based on the embroidery data according to the invention, while limiting numbers of oversewing.

FIG. 24 is an embroidery E3 formed based on the embroidery data while limiting the amount of oversewing. The embroidery E3 has a similar embroidery sewing quality to the embroideries E1 and E2, with even fewer embroidery stitches.

Figure 25A:
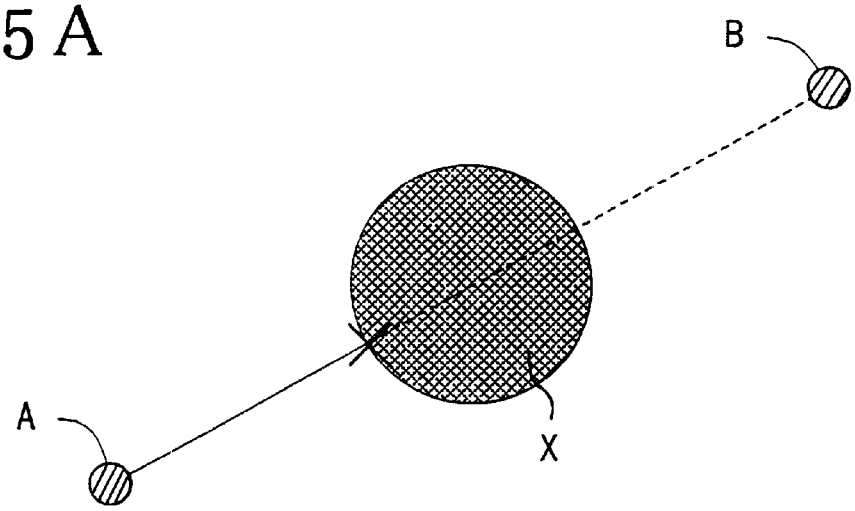
FIGS. 25A to 25C schematically show how an alternative path of feeding stitches is determined.
Figure 25B:
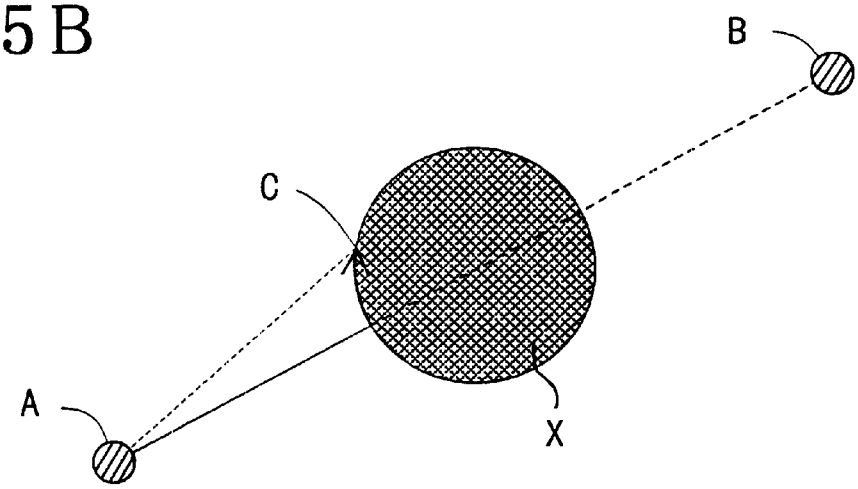
Figure 25C:
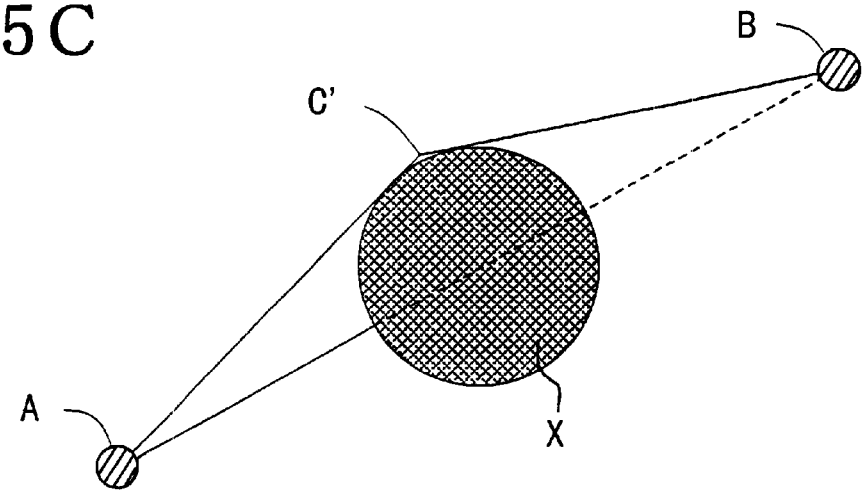

As described above, the feeding stitches are converted into running stitches in this embodiment. FIGS. 25A to 25C show how to determine an alternative path for the running stitches. For example, the running stitches of one thread color can not pass through an area X where the embroidery stitches of another thread color have already been provided, as shown in FIG. 25A. In such a case, it is necessary to provide an alternative path for the running stitches, so as to bypass the area X. The determination of the alternative path will be described in detail below.

The path of the running stitch is revised successively, by moving a point C from an ending point A of a preceding line segment toward a starting point B of a next line segment. If the area X is located between the ending point A and the starting point B, the point C is moved around the area X, without crossing the area X, as shown in FIG. 25B. As shown in FIG. 25C, the alternative path is provided from the ending point A to the starting point B via a point C', wherein the area X is no longer located between the point C' and the ending point A and between the point C' and the starting point B. The running stitches are provided along the alternative path.

It should be noted that the alternative path of running stitches has to be covered with embroidery stitches of different thread colors because the running stitches need to be clothed, or covered, with the embroidery stitches of different thread colors.

Although the length component is set by a predetermined fixed value or an input value input by a user in this embodiment, the length component can be determined based on the angular characteristic intensity for each pixel. In this case, when the angular characteristic intensity I is smaller than a threshold intensity, the length component L is set by a minimum line length ML. On the other hand, when the angular characteristic intensity I is larger than the threshold intensity, the length component L is calculated by the following equation [6], wherein C stands for an arbitrary coefficient. Herein, the threshold intensity, the minimum line length and the coefficient C may be predetermined or an input value input by a user.

$$L=ML+(I\times C) \quad [6]$$

Figure 29:
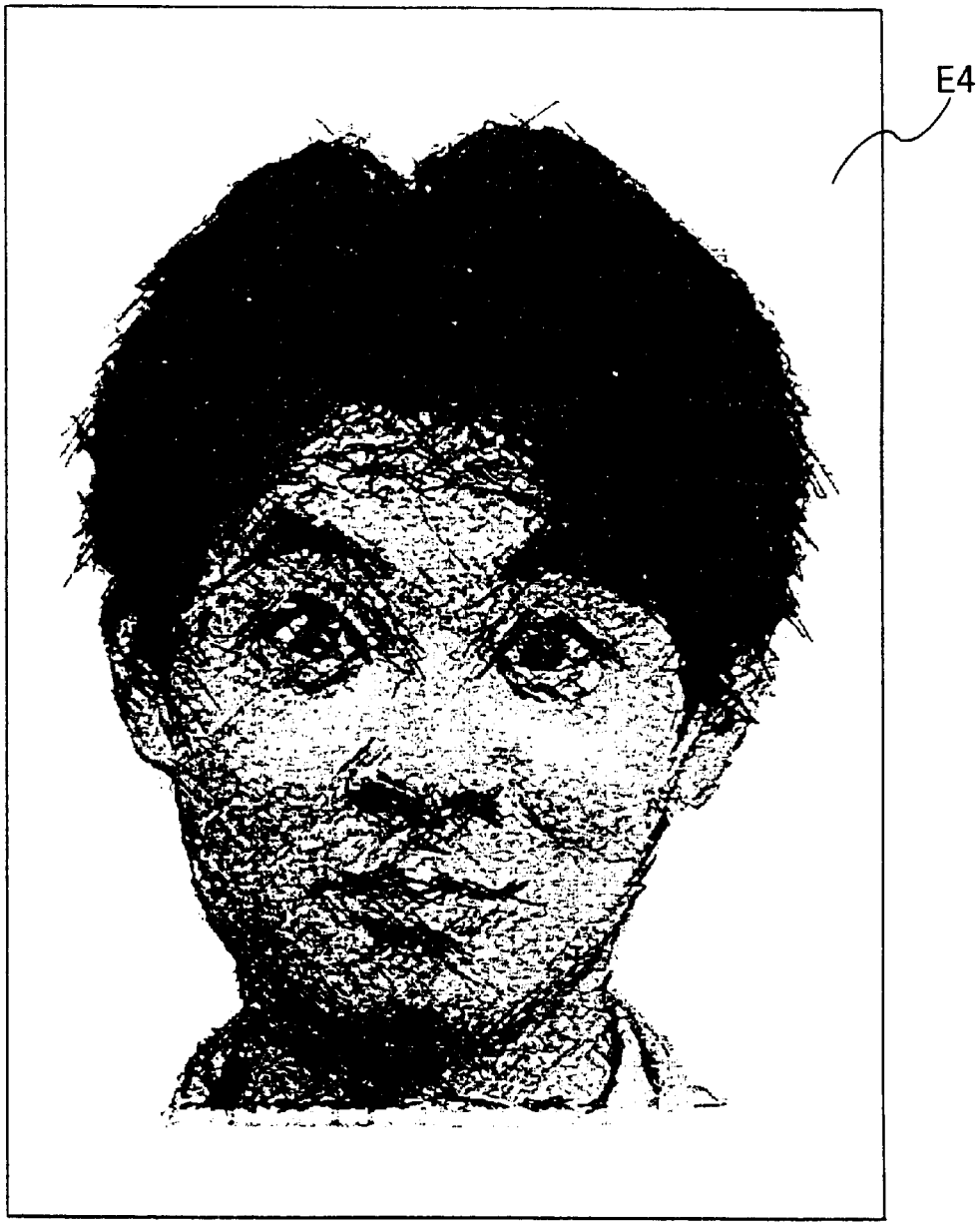
FIG. 29 is an embroidery formed based on the embroidery data according to the invention, by calculating the length component for each line segment.

FIG. 29 is an embroidery E4 formed based on the embroidery data generated by calculating the length component for each line segment in the above-mentioned manner. As shown in FIG. 29, the stitches become long where the angular characteristic intensities are high, while the stitches become short where the angular characteristic intensities are low. This leads to the special properties of the embroidery E4 shown in FIG. 29.

As described above, RGB space is used for dealing with color information in this embodiment. L*a*b* space, L*u*v* space, YIQ space and HSI space could be used in place of RGB space.

Further, the line segment data is generated on a pixel basis in this embodiment. However, for example, if a small-sized embroidery is formed from a large original image, including a large number of pixels, and line segment data is generated for each pixel, the thread density in the embroidery becomes higher than necessary. In such a case, it is preferable to generate the line segment data by block unit, wherein one block includes a plurality of pixels therein. The angular characteristic and its intensity are also determined on a block basis. The pixels are separated into blocks, for example, by compressing the original image, or changing the original image into mosaic image.

Although the invention has been described using one embodiment, it would be apparent to those skilled in the art that various changes and modifications may be made therein without departing from the spirit of the invention.

What is claimed is:

1. A method for generating embroidery data based on image data that represents an image including a plurality of pixels, comprising:

inputting the image data;

calculating an angular characteristic and angular characteristic intensity for each pixel of the image data;

determining an angle component, a length component, and a color component for a line segment;

generating a plurality of line segment data including respective angle components, respective length components and respective color components, each of the plurality of line segment data corresponding to one pixel group that includes at least one pixel therein and defines a line segment, the angular component indicating a direction in which the line segment extends, the length component indicating a length of the line segment, and the color component indicating a color of the line segment; and generating the embroidery data based on the plurality of line segment data, the embroidery data giving embroidery stitches along the line segments defined by the plurality of line segment data.

2. The method as claimed in claim 1, wherein the embroidery data is generated to give the embroidery stitches in respective thread colors corresponding to the color components, the embroidery stitches of one thread color being given successively.

3. The method as claimed in claim 1, wherein each of the pixel groups has a corresponding angular characteristic at a corresponding angular characteristic intensity, and the line segment data is generated for each pixel group based on the corresponding angular characteristic and the corresponding angular characteristic intensity.

4. The method as claimed in claim 3, wherein the pixel groups have respective pixel data, and the angular characteristic indicates a direction in which the pixel data continues, and the angular characteristic intensity indicates a degree of the pixel data.

5. The method as claimed in claim 3, further comprising calculating the angular characteristic and the angular characteristic intensity for each pixel group.

6. The method as claimed in claim 3, wherein the line segment data is generated for a first pixel group of which the angular characteristic intensity is larger than a threshold intensity.

7. The method as claimed in claim 6, wherein the line segment data is further generated for a second pixel group of which the angular characteristic intensity is smaller than the threshold intensity and that is located out of a location area in which the previously generated line segment data defines any line segment.

8. The method as claimed in claim 7, wherein an alternative angular characteristic is calculated for the second pixel group with reference to third pixel groups located around the second pixel group, and the line segment data is generated for the second pixel group based on the calculated alternative angular characteristic.

9. The method as claimed in claim 7, wherein the angular characteristic of the second pixel group is set to a predetermined angular value, and the line segment data is generated for the second pixel group based on the predetermined angular value.

10. The method as claimed in claim 1, wherein the length components are set to a fixed length value, so that the line segments have a same length.

11. The method as claimed in claim 3, wherein the length component is determined for each of the pixel groups based on the corresponding angular characteristic intensity, and the line segment data is generated for each of the pixel groups, including the determined length component.

12. The method as claimed in claim 1, further comprising:

counting a number of the line segments, defined by the line segment data that has previously been generated, passing through one pixel group; and stopping generating any further line segment data on the one pixel group, if the counted number is larger than a threshold number.

13. The method as claimed in claim 1, wherein the color component is determined for each of the pixel groups based on a color of the image, and wherein the line segment data is generated for each of the pixel groups, including the determined color component.

14. The method as claimed in claim 13, wherein the color component is determined for one pixel group, based on an average color of a predetermined image area including the one pixel group therein.

15. The method as claimed in claim 1, further comprising deleting some of the plurality of line segment data.

16. The method as claimed in claim 1, wherein the line segment data of one pixel group is deleted, if the one pixel group is located on a continuation of a line segment of a designated pixel group within a predetermined area, and has a similar angular characteristic to and a lower angular characteristic intensity than the designated pixel group.

17. The method as claimed in claim 1, wherein one line segment data is deleted, if the line segment data defines a line segment of one color component that is to be covered with line segments of other color components, and of which an exposing rate is smaller than a predetermined minimum exposing rate.

18. The method as claimed in claim 2, further comprising combining more than one line segment data into single line segment data, the pixel groups of the more than one line segment data including a same angular component and a same color component, the more than one line segment data defining respective line segments that at least partially overlap one another.

19. The method as claimed in claim 2, wherein the embroidery data is generated to give feeding stitches in one thread color between the line segments along which the embroidery stitches of the one thread color are given, the feeding stitches being uncovered with the embroidery stitches of the one thread color.

20. The method as claimed in claim 19, further comprising determining thread color order in which the embroidery stitches and the feeding stitches are given in the respective thread colors.

21. The method as claimed in claim 20, wherein a feeding stitch of one thread color is changed into running stitches, if the feeding stitch is to be covered with the embroidery stitches of any subsequent thread colors.

22. The method as claimed in claim 21, wherein a sequence of the embroidery stitches is determined for each thread color, so that the feeding stitches of one thread color are covered with the embroidery stitches of any subsequent thread colors.

23. The method as claimed in claim 22, wherein an alternative path is determined for a feeding stitch of one thread color, so that the alternative path is to be covered with the embroidery stitches of at least one subsequent thread color, and wherein the running stitches are given, in place of the feeding stitch, along the alternative path in the one thread color.

24. A computer-readable memory that stores an embroidery data generating program for generating embroidery data based on image data representing an image including a plurality of pixels, the embroidery data generating program comprising:

a program for inputting the image data;

a program for calculating an angular characteristic and an angular characteristic intensity for each pixel of the image data;

a program for determining an angle component, a length component and a color component for a line segment;

a program for generating a plurality of line segment data including respective angle components, respective length components and respective color components, each of the plurality of line segment data corresponding to one pixel group which includes one pixel therein and defines a line segment, the angular component indicating a direction in which the line segment extends, the length component indicating a length of the line segment, and the color component indicating a color of the line segment; and a program for generating the embroidery data based on the plurality of line segment data, the embroidery data giving embroidery stitches along the line segments defined by the plurality of line segment data.

25. An embroidery data generating apparatus for generating embroidery data based on image data that represents an image including a plurality of pixels; comprising:

an input unit that inputs the image data;

a calculating unit that calculates an angular characteristic and an angular characteristic intensity for each pixel of the image data;

a determination unit for determining an angle component, a length component, and a color component for a line segment;

a line segment data generating unit that generates, based on the image data, a plurality of line segment data including respective angle components, respective length components and respective color components, each of the plurality of line segment data corresponding to one pixel group that includes at least one pixel therein and defines a line segment, the angular component indicating a direction in which the line segment extends, the length component indicating a length of the line segment, and the color component indicating a color of the line segment; and an embroidery data generating unit that generates the embroidery data based on the plurality of line segment data, the embroidery data giving embroidery stitches along the line segments defined by the plurality of line segment data.

* * * * *